US009823015B2

(12) United States Patent
Gahier et al.

(10) Patent No.: US 9,823,015 B2
(45) Date of Patent: Nov. 21, 2017

(54) METHOD FOR PRODUCING A FLOW RICH IN METHANE AND A FLOW RICH IN $C2^+$ HYDROCARBONS, AND ASSOCIATED INSTALLATION

(71) Applicant: TECHNIP FRANCE, Courbevoie (FR)

(72) Inventors: Vanessa Gahier, Jouy le Moutler (FR); Julie Gouriou, Rueil Malmaison (FR); Loic Barthe, Paris (FR); Sandra Thiebault, Coye-la-Foret (FR)

(73) Assignee: TECHNIP FRANCE (FR)

( * ) Notice: Subject to any disclaimer, the term of this patent is extended or adjusted under 35 U.S.C. 154(b) by 400 days.

(21) Appl. No.: 14/747,417

(22) Filed: Jun. 23, 2015

(65) Prior Publication Data

US 2015/0292798 A1 Oct. 15, 2015
US 2016/0370109 A9 Dec. 22, 2016

Related U.S. Application Data

(62) Division of application No. 12/831,362, filed on Jul. 7, 2010, now Pat. No. 9,310,128.

(30) Foreign Application Priority Data

Jul. 9, 2009 (FR) ..... 09 54781

(51) Int. Cl.
*F25J 3/02* (2006.01)

(52) U.S. Cl.
CPC ..... *F25J 3/0209* (2013.01); *F25J 3/0233* (2013.01); *F25J 3/0238* (2013.01); *F25J 2200/02* (2013.01); *F25J 2200/30* (2013.01); *F25J 2200/50* (2013.01); *F25J 2200/76* (2013.01); *F25J 2205/04* (2013.01); *F25J 2210/06* (2013.01); *F25J 2230/24* (2013.01); *F25J 2230/60* (2013.01); *F25J 2240/02* (2013.01); *F25J 2245/02* (2013.01); *F25J 2270/02* (2013.01); *F25J 2270/04* (2013.01); *F25J 2270/06* (2013.01); *F25J 2270/88* (2013.01); *F25J 2290/80* (2013.01)

(58) Field of Classification Search
CPC ..... F25J 3/0209; F25J 3/0233; F25J 2210/06
See application file for complete search history.

(56) References Cited

U.S. PATENT DOCUMENTS

| | | | | |
|---|---|---|---|---|
| 2,823,523 | A | 2/1958 | Eakin | 62/622 |
| 3,213,631 | A | 10/1965 | Ludwig | 62/622 |
| 4,687,499 | A | 8/1987 | Aghili | 62/621 |
| 5,265,427 | A | 11/1993 | Stone et al. | 62/635 |
| 5,555,748 | A | 9/1996 | Campbell et al. | 62/621 |

(Continued)

OTHER PUBLICATIONS

French Search Report dated May 7, 2010 issued in corresponding French Application No. 0954781.

*Primary Examiner* — John F Pettitt
(74) *Attorney, Agent, or Firm* — Ostrolenk Faber LLP

(57) ABSTRACT

This method envisions cooling the supply flow in a first heat exchanger, separation in a first separation flask in order to produce a light upper flow and a heavy lower flow and dividing the light upper flow into a supply fraction of a dynamic pressure reduction turbine and a supply fraction of a first distillation column. A cooled reflux flow is formed from an effluent from a dynamic pressure reduction turbine, the portion of the effluent being cooled and at least partially liquefied in a heat exchanger. The cooled reflux flow is introduced from the heat exchanger into the first distillation column.

15 Claims, 8 Drawing Sheets

(56) References Cited

U.S. PATENT DOCUMENTS

| | | | | |
|---|---|---|---|---|
| 5,983,664 | A | 11/1999 | Campbell et al. | 62/621 |
| 6,244,070 | B1 | 6/2001 | Lee et al. | 62/620 |
| 6,363,744 | B2 | 4/2002 | Finn et al. | 62/621 |
| 6,526,777 | B1 | 3/2003 | Campbell et al. | 62/621 |
| 6,578,379 | B2 | 6/2003 | Paradowski | 62/622 |
| 2001/0008073 | A1 | 7/2001 | Finn et al. | 62/621 |
| 2010/0011809 | A1 | 1/2010 | Mak | 62/620 |

METHOD FOR PRODUCING A FLOW RICH IN METHANE AND A FLOW RICH IN C2+ HYDROCARBONS, AND ASSOCIATED INSTALLATION

CROSS REFERENCE TO RELATED APPLICATIONS

The present application is a divisional of U.S. patent application Ser. No. 12/831,362, filed Jul. 7, 2010, which claims priority of French Application No. 0954781, filed Jul. 9, 2009, the entire contents of which are incorporated in full herein by reference.

BACKGROUND OF THE INVENTION

The present invention relates to a method for producing a flow rich in methane and a flow rich in $C_2^+$ hydrocarbons from a supply flow containing hydrocarbons, of the type comprising the following steps:

- cooling at least a first fraction of the supply flow in a first heat exchanger;
- introducing the first cooled supply fraction into a first separation flask in order to produce a light upper flow and a heavy lower flow;
- dividing the light upper flow into a turbine supply fraction and a column supply fraction;
- pressure reduction of the turbine supply fraction in a first dynamic pressure reduction turbine and introduction of at least a portion of the fraction subjected to pressure reduction into the first turbine in a middle portion of a first distillation column;
- cooling and at least partially condensing the column supply fraction in a second heat exchanger, pressure reduction and introduction of the cooled column supply fraction into an upper portion of the first distillation column;
- pressure reduction and partial vaporisation of the heavy lower flow in the first heat exchanger and introduction of the heavy lower flow subjected to pressure reduction into a second separation flask in order to produce an upper gas fraction and a lower liquid fraction;
- pressure reduction of the lower liquid fraction and introduction in the middle portion of the first distillation column;
- cooling and at least partially condensing of the upper gas fraction in the second heat exchanger and introduction into the upper portion of the first distillation column;
- recovery of a lower column flow at the bottom of the first distillation column, the flow rich in $C_2^+$ hydrocarbons being formed from the lower column flow;
- recovery and reheating of an upper column flow rich in methane,
- compressing at least a fraction of the upper column flow in at least a first compressor coupled to the first dynamic pressure reduction turbine and in at least a second compressor;
- forming the flow rich in methane from the reheated and compressed upper column flow;
- removing an extraction flow from the upper column flow;
- cooling and introducing the cooled extraction flow into an upper portion of the first distillation column.

Such a method is intended to extract $C_2^+$ hydrocarbons, such as in particular ethylene, ethane, propylene, propane and heavier hydrocarbons, particularly from natural gas, refinery gas or synthetic gas obtained from other hydrocarbon sources, such as carbon, crude oil, naphtha.

Natural gas generally contains a majority of methane and ethane constituting at least 50 mol % of the gas. It also contains, in a more negligible quantity, heavier hydrocarbons, such as propane, butane, pentane. In some cases, it also contains helium, hydrogen, nitrogen and carbon dioxide.

It is necessary to separate the heavy hydrocarbons from the natural gas in order to comply with at least two imperatives. Firstly, economically, $C_2^+$ hydrocarbons and particularly ethane, propane and butane have a worth which can be exploited. Furthermore, the demand for liquid natural gas as a charge for the petrochemical industry increases continuously and should continue to increase in the years ahead.

Furthermore, for processing reasons, it is desirable to separate the heavy hydrocarbons in order to prevent them from condensing during transport and/or handling of the gases. This allows prevention of incidents such as the occurrence of liquid plugs in transport or processing installations configured for gaseous effluents.

In order to separate the $C_2^+$ hydrocarbons from the natural gas, it is known to use an oil absorption method which allows recovery of up to 90% of the propane and up to approximately 40% of the ethane.

In order to achieve higher recovery rates, cryogenic expansion methods are used.

In a known cryogenic expansion method, a portion of the supply flow containing the hydrocarbons is used for the secondary distillers of a methane separation column. Subsequently, the various effluents, after partial condensation, are combined in order to supply a gas/liquid separator.

As described in U.S. Pat. No. 5,555,748, the light flow obtained in the upper portion of the separator is divided into a first column supply fraction, which is condensed before being conveyed to the upper supply of the distillation column and a second fraction which is conveyed to a dynamic pressure reduction turbine before being reintroduced into the distillation column.

This method has the advantage of being easy to start and of providing substantial operating flexibility, combined with good efficiency and good reliability.

However, economic constraints require a further increase in the efficiency of the method whilst retaining a very high level of efficiency of ethane extraction. It is further necessary to minimise the spatial requirement of the installations and to reduce, or even dispense with, the provision of external coolants such as propane, in particular for carrying out the method on floating installations or in zones which are sensitive in terms of security.

SUMMARY OF THE INVENTION

Therefore, an object of the invention is to obtain a production method which allows separation of a supply flow containing hydrocarbons into a flow rich in $C_2^+$ hydrocarbons and a flow rich in methane, in a very economical and very efficient manner, taking up little space.

To that end, the invention relates to a method of the above-mentioned type, characterised in that the method comprises the following steps:

- forming a cooled reflux flow from at least a portion of an effluent from a dynamic pressure reduction turbine, the portion of the effluent from the dynamic pressure reduction turbine being cooled and at least partially liquefied in a heat exchanger in order to form the cooled reflux flow. The method according to the invention may comprise one or more of the following features, taken in isolation or in accordance with any technically possible combination:

it comprises the following steps:

removing a reboiling flow from the first distillation column at a removal level;

placing the reboiling flow in a heat exchange relationship with the portion of the effluent from a dynamic pressure reduction turbine in the heat exchanger in order to cool and at least partially liquefy the portion of the effluent from the dynamic pressure reduction turbine, and reintroducing the reboiling flow into the first distillation column at a level lower than the removal level;

the effluent of the dynamic pressure reduction turbine is formed by the fraction subjected to pressure reduction from the first dynamic pressure reduction turbine, the method comprising the introduction of the fraction subjected to pressure reduction from the first dynamic pressure reduction turbine into the second heat exchanger in order to be cooled and partially liquefied therein;

it comprises the following steps:

separating the supply flow into a first fraction of the supply flow and at least a second fraction of the supply flow, introducing the first fraction of the supply flow into the first heat exchanger;

introducing at least a portion of the second fraction of the supply flow into a second dynamic pressure reduction turbine, separate from the first dynamic pressure reduction turbine, the fraction subjected to pressure reduction from the second dynamic turbine forming the effluent from the dynamic pressure reduction turbine;

it comprises the following steps:

introducing the fraction subjected to pressure reduction from the second dynamic pressure reduction turbine into a downstream separation flask in order to form a third upper gas flow and a third lower liquid flow;

cooling the third upper gas flow in the heat exchanger in order to form the cooled reflux flow;

the third upper gas flow is introduced, after cooling, into an auxiliary distillation column, the cooled reflux flow being formed from the lower flow of the auxiliary distillation column;

it comprises the following steps:

cooling and partially condensing the second supply flow fraction;

introducing the second cooled supply flow fraction into an upstream separation flask in order to form a second gas fraction and a second liquid fraction;

introducing the second gas fraction into the second dynamic pressure reduction turbine;

introducing the second liquid fraction, after pressure reduction, into a lower portion of the first distillation column;

the whole of the second fraction of the supply flow is introduced into the second dynamic pressure reduction turbine without cooling between the step of separating the supply flow and the step of introducing the second fraction of the supply flow into the second dynamic pressure reduction turbine;

it comprises the following steps:

removing a secondary compression fraction from the upper column flow rich in methane, before the upper column flow rich in methane is passed into the first compressor, passing the secondary compression fraction into a third compressor coupled to the second dynamic pressure reduction turbine;

introducing the compressed secondary compression fraction from the third compressor into the compressed upper column flow, downstream of the first compressor;

it comprises the following steps:

removing a make-up cooling flow from the upper column flow rich in methane or from a flow formed from the upper column flow rich in methane;

pressure reduction and introduction of the make-up cooling flow subjected to pressure reduction into a flow flowing upstream of the first pressure reduction turbine, advantageously into the first fraction of the cooled supply flow or the turbine supply fraction;

it comprises the following steps:

passing the upper column flow rich in methane into the first heat exchanger;

removing an auxiliary pressure reduction flow from the upper column flow rich in methane, after it has been passed into the first heat exchanger;

dynamic pressure reduction of the auxiliary pressure reduction flow in an auxiliary dynamic pressure reduction turbine;

introducing the flow subjected to pressure reduction from the auxiliary dynamic pressure reduction turbine into the upper column flow rich in methane before it is passed into the first heat exchanger;

the second compressor comprises a first compression stage, at least a second compression stage and a cooler interposed between the first compression stage and the second compression stage, the method comprising a step of passing the compressed upper column flow from the first compressor successively into the first compression stage, into the cooler, then into the second compression stage;

the portion of the effluent from the dynamic pressure reduction turbine, the upper column flow, the column supply fraction and the upper gas fraction are placed in a heat exchange relationship in the second heat exchanger; and at least a fraction of the upper column flow and the portion of the effluent of the dynamic pressure reduction turbine are placed in a heat exchange relationship in a downstream heat exchanger separate from the second heat exchanger;

the auxiliary reboiling flow is placed in a heat exchange relationship with the flow from the dynamic pressure reduction turbine in the second heat exchanger;

no external cooling cycle is used to cool the first fraction of the supply flow in the first heat exchanger;

the lower column flow is pumped and is advantageously reheated by being placed in a heat exchange relationship with at least a fraction of the supply flow up to a temperature less than its bubble temperature.

The invention further relates to an installation for producing a flow rich in methane and a flow rich in $C_2^+$ hydrocarbons from a supply flow containing hydrocarbons, of the type comprising:

a first heat exchanger for cooling at least a first fraction of the supply flow;

a first separation flask and means for introducing the first cooled supply fraction into the first separation flask in order to produce a light upper flow and a heavy lower flow;

means for dividing the light upper flow into a turbine supply fraction and a column supply fraction;

a first distillation column;

pressure reduction means for the turbine supply fraction comprising a first dynamic pressure reduction turbine and means for introducing at least a portion of the fraction subjected to pressure reduction into the first turbine in a middle portion of the first distillation column;

means for cooling and at least partially condensing the column supply fraction comprising a second heat exchanger and means for pressure reduction and introduction of the cooled column supply fraction into an upper portion of the first distillation column;

means for pressure reduction and means for partial vaporisation of the heavy lower flow comprising the first heat exchanger;

a second separation flask and means for introducing the heavy lower flow into the second separation flask in order to produce an upper gas fraction and a lower liquid fraction;

means for pressure reduction of the lower liquid fraction and means for introduction into the middle portion of the first distillation column;

means for cooling and at least partially condensing the upper gas fraction comprising the second heat exchanger and means for introducing the upper gas fraction into the upper portion of the first distillation column;

means for recovering a lower column flow at the bottom of the first distillation column, and means for forming the flow rich in $c_2^+$ hydrocarbons from the lower column flow;

means for recovering and reheating an upper column flow rich in methane, at the top of the first distillation column;

means for compressing at least a fraction of the upper column flow comprising at least a first compressor coupled to the first dynamic pressure reduction turbine and at least a second compressor;

means for forming the flow rich in methane from the reheated and compressed upper column flow;

means for removing from the upper column flow an extraction flow, means for cooling and introducing the cooled extraction flow into an upper portion of the first distillation column; characterised in that the installation comprises:

means for forming a cooled reflux flow from at least a portion of an effluent from a dynamic pressure reduction turbine, the portion of the effluent from the dynamic pressure reduction turbine being cooled and at least partially liquefied in a heat exchanger in order to form the cooled reflux flow, means for introducing the cooled reflux flow from the heat exchanger into the first distillation column.

The invention will be better understood from a reading of the following description, which is given purely by way of example and with reference to the appended drawings, in which:

DESCRIPTION OF PREFERRED EMBODIMENTS

Figure 1:
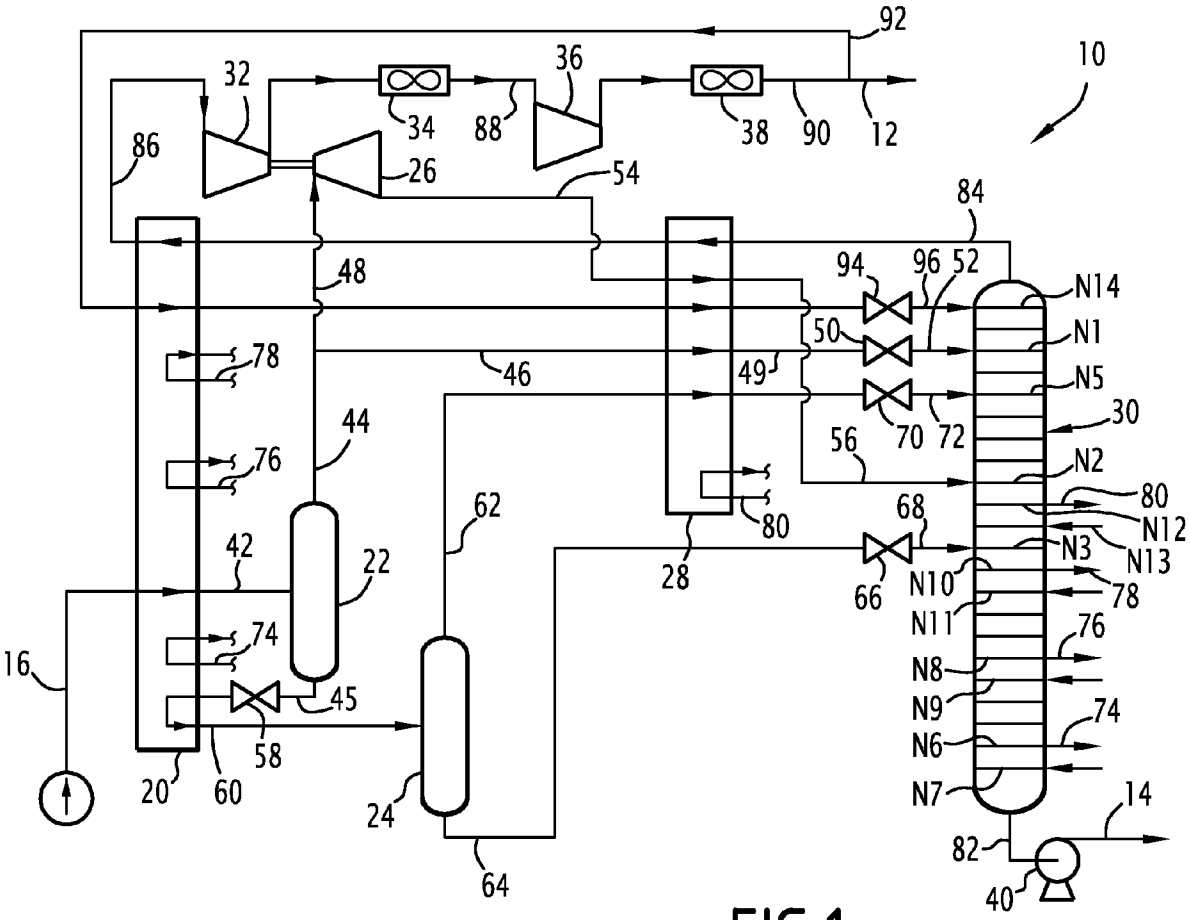
FIG. 1 is a functional schematic illustration of a first production installation intended for carrying out a first method according to the invention.

Hereinafter, a flow flowing in a conduit and the conduit which transports it will be referred to using the same reference numerals.

Furthermore, unless otherwise indicated, the percentages set out are molar percentages and the pressures are given in bar absolute. The efficiency level of each compressor is selected to be 82% polytropic and the efficiency level of each turbine is 85% adiabatic. Similarly, the distillation columns described use plates but they can also use loose or structured lining. A combination of plates and lining is also possible. The additional turbines described drive compressors but they can also drive electrical generators having variable frequency whose electricity produced may be used in the network by means of a frequency converter. The flows whose temperature is above ambient are described as being cooled by air coolers. In a variant, it is possible to use water exchangers, for example, with fresh water or sea water.

FIG. 1 illustrates a first installation 10 for producing a flow 12 rich in methane and a cut 14 rich in $C_2^+$ hydrocarbons according to the invention, from a supply gas flow 16.

The gas flow 16 is a flow of natural gas, a flow of refinery gas or a flow of synthetic gas obtained from a hydrocarbon source such as carbon, crude oil, naphtha. In the example illustrated in the Figures, the flow 16 is a flow of dehydrated natural gas.

The method and the installation 10 are advantageously used in the construction of a new unit for the recovery of methane and ethane.

The installation 10 comprises, in a downstream direction, a first heat exchanger 20, a first separation flask 22, a second separation flask 24 and a first dynamic pressure reduction turbine 26, capable of producing work during the pressure reduction of a flow passing through the turbine.

The installation further comprises a second heat exchanger 28, a first distillation column 30, a first compressor 32 coupled to the first dynamic pressure reduction turbine 26, a first cooler 34, a second compressor 36, a second cooler 38 and a column bottom pump 40.

A first production method according to the invention, carried out in the installation 10, will now be described.

The supply flow 16 of a dehydrated natural gas comprises, in moles, 2.06% of nitrogen, 83.97% of methane, 6.31% of ethane, 3.66% of propane, 0.70% of isobutane, 1.50% of n-butane, 0.45% of isopentane, 0.83% of n-pentane and 0.51% of carbon dioxide.

Therefore, the supply flow 16 more generally has, in moles, between 5% and 15% of $C_2^+$ hydrocarbons to be extracted and between 75% and 90% of methane. The term "dehydrated gas" is intended to refer to a gas whose water content is as low as possible and is particularly less than 1 ppm.

The supply flow 16 has a pressure greater than 35 bar and a temperature similar to the ambient temperature and particularly substantially of 30° C. The flow rate of the supply flow is in this example 15,000 kmol/hour.

In the example illustrated, the supply flow 16 is introduced in its entirety into the first heat exchanger 20, where it is cooled and partially condensed in order to form a fraction 42 of cooled supply flow.

The temperature of the fraction 42 is less than −10° C. and is particularly of −26° C. Subsequently, the cooled fraction 42 is introduced into the first separation flask 22.

The liquid content of the cooled fraction 42 is less than 50 mol %.

A light upper gas flow 44 and a heavy lower liquid flow 45 are extracted from the first separation flask 22. The gas flow 44 is divided into a minority column supply fraction 46 and a majority turbine supply fraction 48. The ratio of the molar flow of the majority fraction 48 to the minority fraction 46 is greater than 2.

The column supply fraction 46 is introduced into the second exchanger 28 in order to be completely liquefied and sub-cooled therein. It forms a cooled column supply fraction 49.

That fraction 49 is subjected to pressure reduction in a first static pressure reduction valve 50 in order to form a fraction 52 subjected to pressure reduction that is introduced by reflux into the first distillation column 30.

The temperature of the fraction 52 subjected to pressure reduction obtained after being passed through the valve 50 is less than −70° C. and is particularly of −109° C.

The pressure of the fraction 52 subjected to pressure reduction is further substantially equal to the operating pressure of the column 30 which is less than 40 bar and in particular between 10 bar and 30 bar, advantageously of 20 bar.

The fraction 52 is introduced into an upper portion of the column 30 at a level N1 located, for example, at the fifth stage from the top of the column 30.

The turbine supply fraction 48 is introduced into the first dynamic pressure reduction turbine 26. It is subjected to dynamic expansion as far as a pressure in the region of the operating pressure of the column 30 in order to form a supply fraction 54 subjected to pressure reduction which has a temperature of less than −50° C.

According to the invention, the fraction 54 subjected to pressure reduction is conveyed into the second heat exchanger 28 in order to be cooled therein and to form an additional cooled reflux flow 56.

The expansion of the supply fraction 48 in the first turbine 26 allows recovery of 4584 kW of energy which cools the fraction 48.

According to the invention, the flow 54, which is an effluent from a dynamic pressure reduction turbine 26 is cooled and is at least partially liquefied to constitute a first cooled reflux flow 56.

The temperature of the cooled reflux flow 56 is less than −60° C.

The liquid content of the cooled reflux flow 56 is greater than 5 mol %.

The cooled reflux flow 56 is introduced into a middle portion of the column 30 located below the upper portion, at a level N2 corresponding to the tenth stage from the top of the column 30.

The liquid flow 45 recovered at the bottom of the first separation flask 22 is subjected to pressure reduction in a second static pressure reduction valve 58, then is reheated in the first heat exchanger 20 and is partially vaporised in order to form a heavy flow 60 subjected to pressure reduction.

The pressure of the heavy flow 60 subjected to pressure reduction is less than 50 bar and is particularly substantially of 20.7 bar. The temperature of the heavy flow 60 subjected to pressure reduction is greater than −50° C. and is particularly substantially of −20° C.

The heavy flow 60 subjected to pressure reduction is subsequently introduced into the second separation flask 24 in order to be separated therein into an upper gas fraction 62 and a lower liquid fraction 64.

The lower liquid fraction 64 is subjected to pressure reduction substantially to the operating pressure of the column 30 through a third static pressure reduction valve 66. The liquid fraction 68 subjected to pressure reduction from the third valve 66 is introduced by reflux into a middle portion of the first column 30, at a level N3 located below the level N2, advantageously at the fourteenth stage from the top of the first column 30.

The upper gas fraction 62 is introduced into the second heat exchanger 28 in order to be cooled and completely liquefied therein. It is subsequently subjected to pressure reduction in a fourth static pressure reduction valve 70 and forms a fraction 72 subjected to pressure reduction. The temperature of the fraction 72 subjected to pressure reduction is less than −70° C. and is particularly of −106.9° C. Its pressure is substantially equal to the pressure of the column 30.

The fraction 72 subjected to pressure reduction is introduced by reflux into an upper portion of the column 30 located at a level N5 positioned between the level N1 and the level N2, advantageously at the fifth stage from the top of the column 30. The temperature of the liquid fraction 68 subjected to pressure reduction is less than 0° C. and is particularly of −20.4° C.

A first reboiling flow 74 is removed in the region of the bottom of the column 30 at a temperature greater than −3° C. and particularly substantially of 12.08° C., at a level N6 advantageously located at the twenty-first stage from the top of the column 30.

The first flow 74 is brought to the first heat exchanger 20 where it is reheated up to a temperature greater than 3° C. and in particular of 18.88° C. before being conveyed to a level N7 corresponding to the twenty-second stage from the top of the column 30.

A second reboiling flow 76 is removed at a level N8 located above the level N6 and below the level N3, advantageously at the eighteenth stage from the top of the column. The second reboiling flow 76 is introduced into the first heat exchanger 20 in order to be reheated therein to a temperature greater than −8° C. and in particular of 7.23° C. It is subsequently conveyed into the column 30 at a level N9 located below the level N8 and above the level N6, advantageously at the nineteenth stage from the top of the column 30.

A third reboiling flow 78 is removed at a level N10 located below the level N3 and above the level N8, advantageously at the fifteenth stage from the top of the column 30. The third reboiling flow 78 is subsequently conveyed to the first heat exchanger 20 where it is reheated to a temperature greater than −30° C. and particularly of −15.6° C. before being conveyed to a level N11 of the column 30 located below the level N10 and above the level N8, advantageously at the sixteenth stage from the top of the column 30.

According to the invention, a fourth reboiling flow 80 is removed from a middle portion of the column 30 at a level N12 located below the level N2 and above the level N3, and advantageously at the twelfth stage from the top of the column 30.

That fourth reboiling flow 80 is conveyed to the second heat exchanger 28 where it is reheated by heat exchange with the effluent 54 from the turbine 26 up to a temperature greater than −50° C. It thereby exchanges thermal power which allows provision of a portion of the kilogram calories necessary for the formation of the cooled reflux flow 56. The fourth flow 80 is subsequently reintroduced into the column 30 at a level N13 located below the level N12 and above the level N3, advantageously at the thirteenth stage from the top of the column 30.

In that manner, the flows 52, 72 and 96 are introduced into the upper portion of the column 30 which extends from a height greater than 35% of the height of the column 30, whilst the flows 56 and 68 are introduced into a middle portion which extends below the upper portion.

The column 30 produces at the bottom a liquid lower column flow 82. The lower column flow 82 has a temperature greater than 4° C. and in particular of 18.9° C.

In that manner, the lower flow 82 contains, in moles, 1.45% of carbon dioxide, 0% of nitrogen, 0.46% of methane, 45.83% of ethane, 26.80% of propane, 5.18% of i-butane, 10.96% of n-butane, 3.26% of i-pentane, 6.07% of n-pentane.

More generally, the flow 82 has a ratio C1/C2 of less than 3 mol %, for example, of 1%.

It contains more than 95 mol %, advantageously more than 99 mol % of the ethane contained in the supply flow 16 and it contains substantially 100 mol % of the $C_3^+$ hydrocarbons contained in the supply flow 16.

The lower column flow 82 is pumped in the pump 40 in order to form the cut 14 rich in $C_2^+$ hydrocarbons.

It may advantageously be reheated by being placed in a heat exchange relationship with at least one fraction of the supply flow 16 up to a temperature less than its bubble temperature, in order to keep it in liquid form.

The column 30 produces at the top a gaseous upper column flow 84 rich in methane. The flow 84 has a temperature less than −70° C. and particularly substantially of −108.9° C. It has a pressure substantially equal to the pressure of the column 30, for example, of 19.0 bar.

The upper flow 84 is successively introduced into the second heat exchanger 28, then into the first heat exchanger 20 in order to be reheated therein and to form a reheated upper flow 86 rich in methane. The flow 86 has a temperature greater than −10° C. and in particular of 27.5° C.

Subsequently, the flow 86 is introduced successively into the first compressor 32 driven by the main turbine 26 in order to be compressed therein to a pressure of substantially 40 bar, before being introduced into the first air cooler 34 in order to be cooled therein to a temperature less than 60° C., in particular of 40° C.

The partially compressed flow 88 obtained in this manner is introduced into the second compressor 36 then into the second cooler 38 in order to form a compressed upper flow 90. In that manner, the flow 90 has a pressure greater than 35 bar and particularly substantially of 63.1 bar.

The cooled upper column flow 90 substantially forms the flow rich in methane 12 produced by the method according to the invention.

Its composition is advantageously 97.19 mol % of methane, 2.39 mol % of nitrogen and 0.06 mol % of ethane. It further comprises more than 99% of the methane contained in the supply flow 16 and less than 5% of the $C_2^+$ hydrocarbons contained in the supply flow 16.

As illustrated in FIG. 1, an extraction flow 92 is removed from the compressed upper flow 90. The flow 92 has a non zero molar flow of between 0% and 35% of the molar flow of the compressed upper flow 90 upstream of the removal location, the remainder of the compressed upper flow 90 forming the flow 12.

The extraction flow 92 is cooled successively in the first exchanger 20, then in the second exchanger 28, before being subjected to pressure reduction in a fifth static pressure reduction valve 94.

The flow 96, which is substantially liquefied before pressure reduction in the valve 94, has, after pressure reduction, a liquid fraction greater than 0.8. The extraction flow 96 subjected to pressure reduction from the fifth valve 94 is subsequently introduced by reflux in the region of the top of the column 30 at a level N14 located above the level N1 and advantageously corresponding to the first stage of the column 30.

The temperature of the extraction flow 96 subjected to pressure reduction before it is introduced into the column 30 is less than −70° C. and is advantageously of −111.4° C. Examples of temperature, pressure and molar flow of the different flows are set out in Table 1 below.

TABLE 1

| Flow | Temperature (° C.) | Pressure (bar) | Flow (kgmol/h) |
|---|---|---|---|
| 12 | 40.0 | 63.1 | 12950 |
| 14 | 19.4 | 24.2 | 2050 |
| 16 | 30.0 | 62.0 | 15000 |
| 42 | −26.0 | 61.0 | 15000 |
| 44 | −26.0 | 61.0 | 13472 |
| 45 | −26.0 | 61.0 | 1528 |
| 46 | −26.0 | 61.0 | 1350 |
| 48 | −26.0 | 61.0 | 12122 |
| 49 | −106.9 | 60.0 | 1350 |
| 52 | −109.0 | 19.2 | 1350 |
| 54 | −74.2 | 19.2 | 12122 |
| 56 | −84.0 | 19.1 | 12122 |
| 60 | −20.0 | 20.2 | 1528 |
| 62 | −20.0 | 20.2 | 685 |
| 64 | −20.0 | 20.2 | 843 |
| 68 | −20.4 | 19.2 | 843 |
| 72 | −106.9 | 19.2 | 685 |
| 82 | 18.9 | 19.2 | 2050 |
| 84 | −108.9 | 19.0 | 15080 |
| 86 | 27.5 | 18.0 | 15080 |
| 88 | 40.0 | 25.1 | 15080 |
| 90 | 40.0 | 63.1 | 15080 |
| 92 | 40.0 | 63.1 | 2130 |
| 96 | −111.4 | 19.2 | 2130 |

In relation to an installation of the prior art, as described, for example, in the American patent U.S. Pat. No. 6,578,379, the energy consumption of the method, constituted by the energy for driving the second compressor 36 is 13630 kW in comparison with 14494 kW with a method according to U.S. Pat. No. 6,578,379, wherein the same charge flow to be processed is used.

In relation to the prior art, therefore, the method according to the invention allows achievement of a substantial reduction in the power consumed, whilst maintaining strong selectivity for the extraction of ethane.

Figure 2:
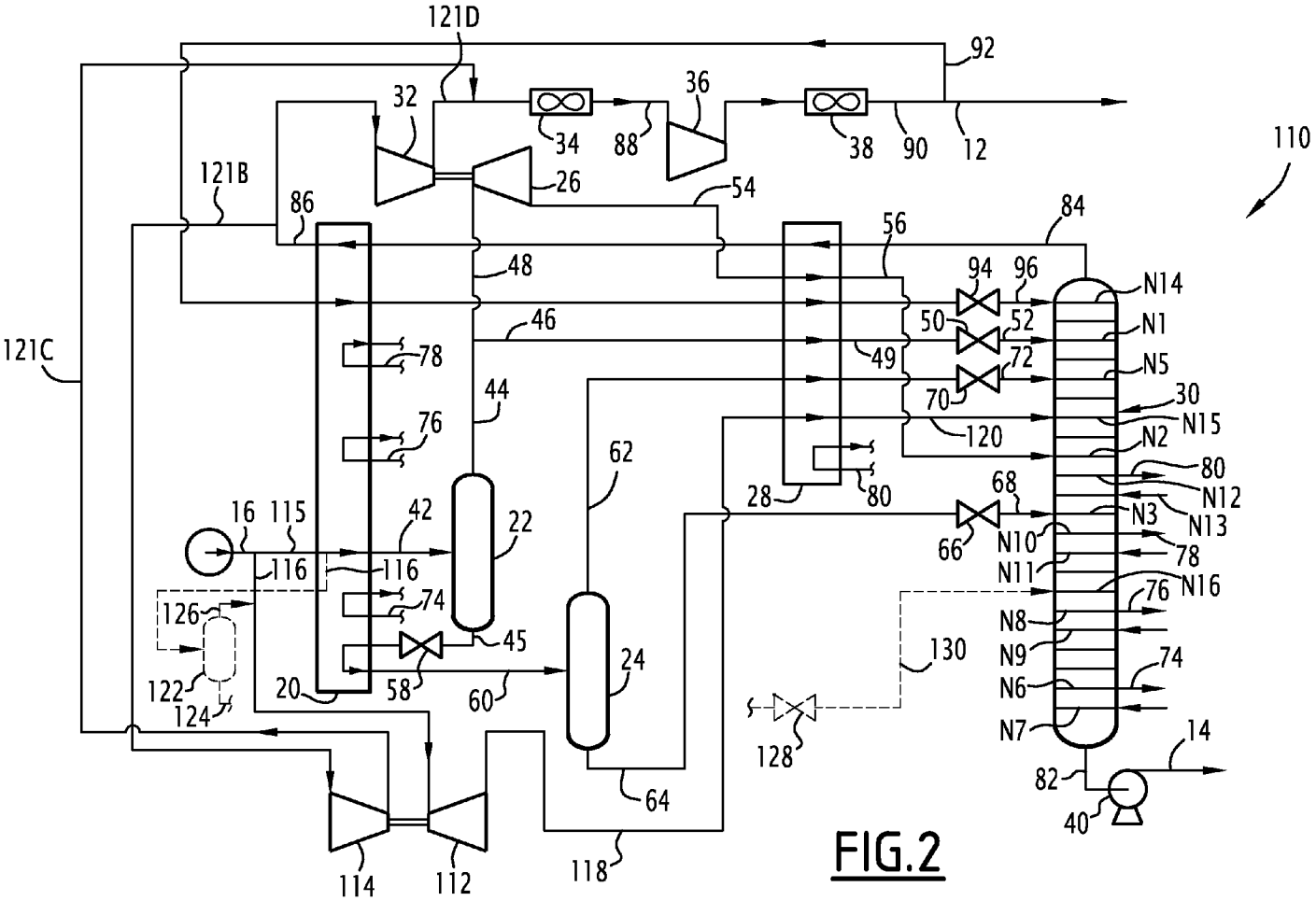
FIG. 2 is a functional schematic illustration of a second production installation intended for carrying out a second method according to the invention.

A second installation 110 according to the invention is illustrated in FIG. 2. That installation 110 is intended to carry out a second method according to the invention.

Unlike the first installation 10, the second installation 110 comprises a second dynamic pressure reduction turbine 112 coupled to a third compressor 114.

Unlike the first method according to the invention, the supply flow 16 is divided into a first supply flow fraction 115 and a second supply flow fraction 116.

The ratio of the molar flow of the first fraction 115 to the second fraction 116 is, for example, greater than 2 and is particularly between 2 and 15.

The first fraction 115 is directed to the first heat exchanger 20 in order to form the cooled fraction 42.

The second fraction 116 is directed to the second dynamic pressure reduction turbine 112 in order to be subjected to pressure reduction dynamically therein as far as a pressure of less than 40 bar, advantageously substantially equal to the pressure of the column 30.

The second supply fraction 118 subjected to pressure reduction and recovered at the outlet of the second pressure reduction turbine 112 thus has a temperature of less than 0° C. and particularly of −24° C. Thermal expansion in the turbine 112 allows 1364 kW to be recovered to cool the flow.

The fraction 118 is subsequently introduced into the second heat exchanger 28 in order to be cooled therein and at least partially liquefied. The cooled fraction 120 from the second exchanger 28 forms a second cooled reflux flow which is introduced into the column 30 at a higher level N15 located between the level N2 and the level N5, advantageously at the sixth stage from the top of the column 30.

The temperature of the second cooled reflux flow 120 is, for example, less than −70° C. and is particularly of −104.8° C. According to the invention, the second cooled reflux flow 120 is formed from an effluent 118 of a dynamic pressure reduction turbine 112, that effluent 118 being cooled in the second heat exchanger 28 before being introduced into the column 30.

In a variant illustrated with broken lines in FIG. 2, the second fraction 116 is removed from the exchanger 20 in order to be partially cooled and partially liquefied therein. The second fraction 116 is introduced into an upstream separation flask 122. The second fraction 116 is separated in the flask 122 into a second lower liquid fraction 124 and a second upper gas fraction 126.

The second lower fraction 124 is subjected to pressure reduction in a sixth static pressure reduction valve 128 as far as a pressure of less than 40 bar and substantially equal to the pressure of the column 30. It thereby forms a second liquid fraction 130 which is subjected to pressure reduction and which is introduced at a level N16 of the column 30 located between the level N11 and the level N8, advantageously at the fifteenth stage from the top of the column 30.

The second upper fraction 126 is introduced into the second dynamic pressure reduction turbine 112 in order to form the second supply fraction 118 subjected to pressure reduction. The ratio of the molar flow of the second lower fraction 124 to the second upper fraction 126 is less than 0.2.

Furthermore, the reheated upper flow 86 is separated, at the outlet of the first heat exchanger 20, into a first reheated upper flow fraction 121A conveyed to the first compressor 32 and a second reheated upper flow fraction 121B conveyed to the third compressor 114. The fraction 121B is compressed in the third compressor 114 as far as a pressure greater than 15 bar.

The compressed fraction 121C obtained at the outlet of the third compressor 114 is mixed with the compressed fraction 121D obtained at the outlet of the first compressor 32, before they are introduced into the first cooler 34.

That parallel arrangement of the compressors 32, 114 allows a breakdown of one or other of the compressors to be overcome without having to completely stop the installation.

Examples of temperature, pressure and molar flow of the different flows are set out in Table 2 below.

TABLE 2

| Flow | Temperature (° C.) | Pressure (bar) | Flow (kgmol/h) |
|---|---|---|---|
| 12 | −108.7 | 61.6 | 1588 |
| 14 | 15.3 | 22.9 | 2055 |
| 16 | 30.0 | 62.0 | 15000 |
| 42 | −32.0 | 61.0 | 12500 |
| 44 | −32.0 | 61.0 | 10936 |
| 45 | −32.0 | 61.0 | 1564 |
| 46 | −32.0 | 61.0 | 645 |
| 48 | −32.0 | 61.0 | 10291 |
| 49 | −108.7 | 60.0 | 645 |
| 52 | −111.2 | 17.9 | 645 |
| 54 | −81.4 | 18.4 | 10291 |
| 56 | −85.0 | 17.9 | 10291 |
| 60 | −35.0 | 36.5 | 1564 |
| 62 | −35.0 | 36.5 | 448 |
| 64 | −35.0 | 36.5 | 1116 |
| 68 | −44.8 | 17.9 | 1116 |
| 72 | −109.5 | 17.9 | 448 |
| 82 | 14.9 | 17.9 | 2055 |
| 84 | −110.7 | 17.7 | 14534 |
| 86 | 25.1 | 16.7 | 14534 |
| 88 | 40.0 | 24.7 | 14534 |
| 90 | 40.0 | 63.1 | 14534 |
| 92 | 40.0 | 63.1 | 1588 |
| 96 | −113.3 | 17.9 | 1588 |
| 115 | 30.0 | 62.0 | 12500 |
| 116 | 30.0 | 62.0 | 2500 |
| 118 | −24.0 | 18.9 | 2500 |
| 120 | −104.8 | 17.9 | 2500 |
| 121C | 61.6 | 25.2 | 3829 |
| 121D | 61.6 | 25.2 | 10704 |

The total consumption of the method is further reduced in relation to the first method according to the invention in order to be approximately 13392 kW.

In a variant which is not illustrated, the second compressor 36 comprises two compression stages which are separated by an air cooler. The arrangement obtained in this manner allows additional power economy of 884 kW.

The power consumed by the compressor 36 in accordance with the flow of the second supply flow fraction 116 is set out in Table 3 below.

TABLE 3

| Recovery of ethane mol% | Flow to turbine 112 kmol/h | Power of turbine 26 kW | Power of turbine 112 kW | Power of compressor 36 kW |
|---|---|---|---|---|
| 99.20 | 1000 | 4111 | 546 | 13842 |
| 99.19 | 1500 | 3997 | 819 | 13567 |
| 99.20 | 2000 | 3904 | 1091 | 13446 |
| 99.18 | 2500 | 3812 | 1364 | 13392 |
| 99.19 | 3000 | 3721 | 1637 | 13425 |
| 99.20 | 3500 | 3631 | 1910 | 13534 |

According to this table, it is possible to obtain an increase in power of at least 7.6% in relation to the method described in the prior art.

Furthermore, for a flow ratio of between 4 and 6.5, between the flow of the first supply flow fraction 115 and the second supply flow fraction 116, a minimum level of power consumed is observed.

Figure 3:
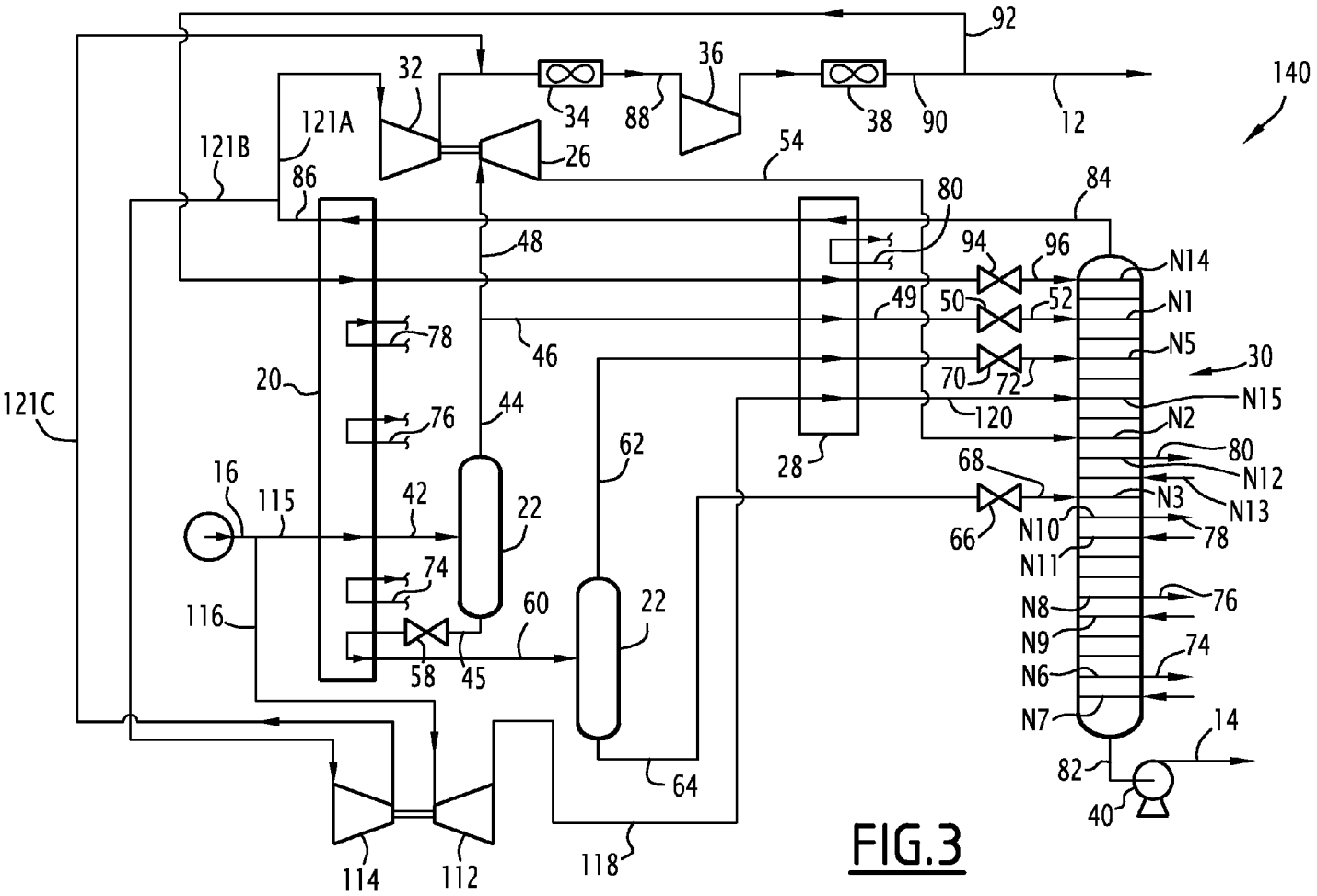
FIG. 3 is a functional schematic illustration of a third production installation intended for carrying out a third method according to the invention.

A third installation according to the invention 140 is illustrated in FIG. 3. That third installation is intended to carry out a third method according to the invention. Unlike the second installation 110, the flow 54 from the first pressure reduction turbine 26 is conveyed directly by reflux into the column 30, at the level N2, without being cooled, particularly in the second heat exchanger 28. Examples of temperature, pressure and molar flow of the different flows are set out in Table 4 below.

TABLE 4

| Flow | Temperature (° C.) | Pressure (bar) | Flow (kgmol/h) |
|---|---|---|---|
| 12 | 40.0 | 63.1 | 12951 |
| 14 | 16.7 | 23.2 | 2049 |
| 16 | 30.0 | 62.0 | 15000 |
| 42 | −34.0 | 61.0 | 12000 |
| 44 | −34.0 | 61.0 | 10392 |
| 45 | −34.0 | 61.0 | 1608 |
| 46 | −34.0 | 61.0 | 315 |
| 48 | −34.0 | 61.0 | 10077 |
| 49 | −108.3 | 60.0 | 315 |
| 52 | −110.8 | 18.2 | 315 |
| 54 | −83.7 | 18.2 | 10077 |
| 60 | −35.0 | 36.0 | 1608 |
| 62 | −35.0 | 36.0 | 503 |
| 64 | −35.0 | 36.0 | 1104 |
| 68 | −44.5 | 18.2 | 1104 |
| 72 | −108.9 | 18.2 | 503 |
| 82 | 16.2 | 18.2 | 2049 |
| 84 | −110.3 | 18.0 | 14821 |
| 86 | 23.6 | 17.0 | 14821 |
| 88 | 40.0 | 25.3 | 14821 |
| 90 | 40.0 | 63.1 | 14821 |
| 92 | 40.0 | 63.1 | 1870 |
| 96 | −112.8 | 18.2 | 1870 |
| 115 | 30.0 | 62.0 | 12000 |
| 116 | 30.0 | 62.0 | 3000 |
| 118 | -23.5 | 19.2 | 3000 |
| 120 | −104.2 | 18.2 | 3000 |
| 121C | 60.4 | 25.8 | 4514 |
| 121D | 60.4 | 25.8 | 10307 |

Figure 4:
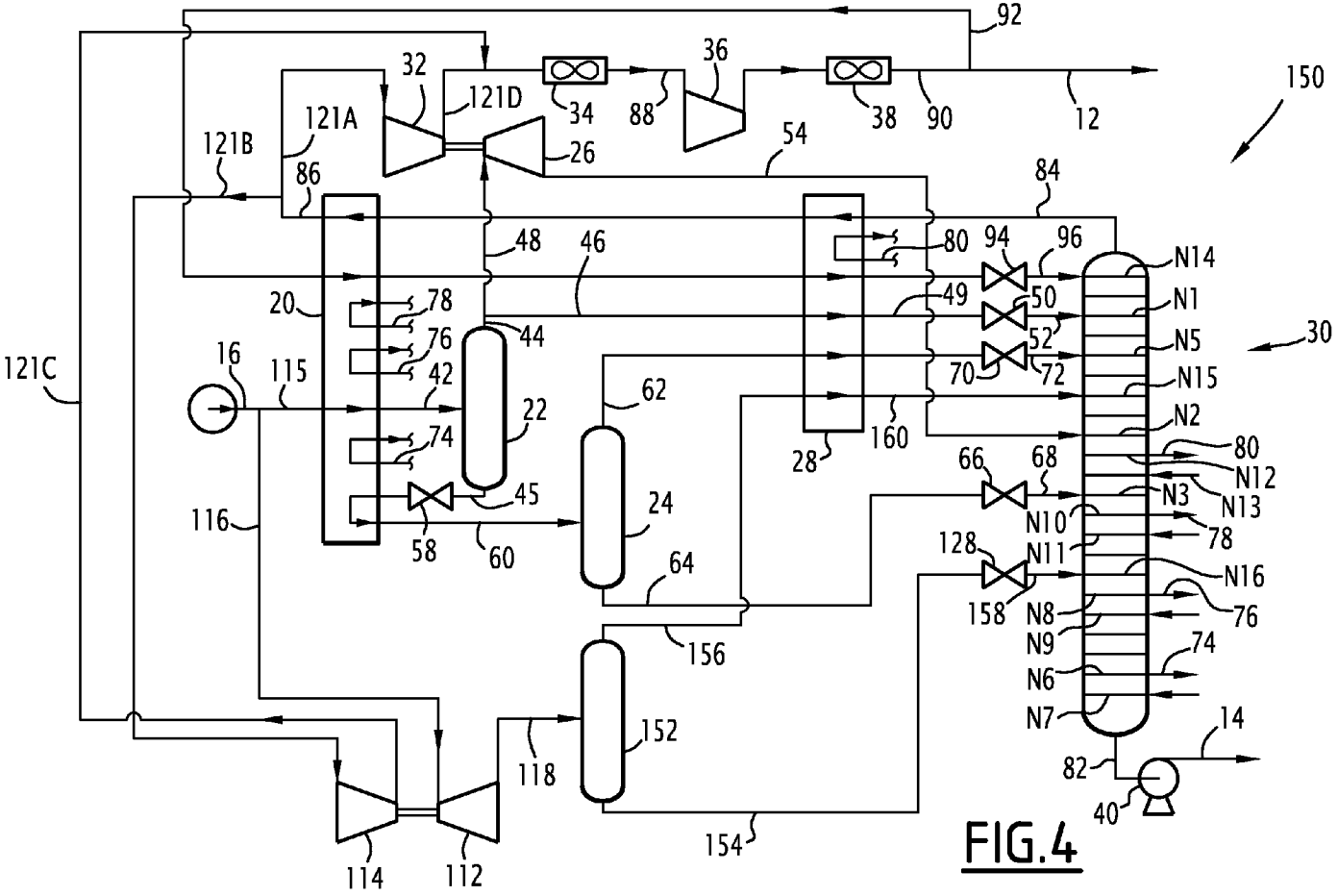
FIG. 4 is a functional schematic illustration of a fourth production installation intended for carrying out a fourth method according to the invention.

A fourth installation 150 according to the invention is illustrated in FIG. 4. That fourth installation 150 is intended to carry out a fourth method according to the invention.

The fourth method is advantageously used for a supply flow 16 having heavy hydrocarbons which tend to solidify at low temperature. Those heavy hydrocarbons are, for example, of $C_6^+$. In that manner, the concentration of $C_6^+$ hydrocarbons is greater than 0.3 mol % in the supply flow 16.

An example of a supply flow 16 for carrying out the fourth method according to the invention comprises, in moles, 2.06% of nitrogen, 83.97% of methane, 6.31% of ethane, 3.66% of propane, 0.7% of isobutane, 1.5% of n-butane, 0.45% of isopentane, 0.51% of n-pentane, 0.19% of n-hexane, 0.10% of n-heptane, 0.03% of n-octane and 0.51% of carbon dioxide.

Unlike the third installation 140, the fourth installation 150 according to the invention comprises a downstream separation flask 152 which is positioned at the outlet of the second pressure reduction turbine 112.

In that manner, the fourth method according to the invention differs from the third method according to the invention in that the cooled and partially liquefied second supply fraction 118 is introduced into the downstream flask 152. That fraction 118 is separated in the downstream flask 152 into a third lower liquid flow 154 and a third upper gas flow 156.

The third lower liquid flow 154 is introduced into a sixth static pressure reduction valve 128 in order to be subjected to pressure reduction therein and to form a third lower flow 158 subjected to pressure reduction.

The third lower flow 158 subjected to pressure reduction has a temperature greater than 0° C. and in particular of −23.3° C. It has a pressure substantially equal to the pressure of the column 30.

The third lower flow 158 subjected to pressure reduction is introduced into the column 30 at a level N16 located between the level N11 and the level N8, substantially at the thirteenth stage from the top of the column 30.

The third upper flow 156, which forms a portion of the effluent 118 from the second dynamic pressure reduction turbine 112 is introduced into the second exchanger 28 in order to be cooled and partially liquefied therein, before forming a third cooled reflux flow 160.

The temperature of the third cooled reflux flow 160 is less than −70° C. That cooled reflux flow 160 is introduced into the column 30 at the level N15.

The implementation of the fourth method according to the invention is further similar to that of the third method according to the invention.

Examples of temperature, pressure and molar flow of the different flows are set out in Table 5 below.

TABLE 5

| Flow | Temperature (° C.) | Pressure (bar) | Flow (kgmol/h) |
|---|---|---|---|
| 12 | 40.0 | 63.1 | 12948 |
| 14 | 16.3 | 23.2 | 2052 |
| 16 | 30.0 | 62.0 | 15000 |
| 42 | −34.2 | 61.0 | 12000 |
| 44 | −34.2 | 61.0 | 10397 |
| 45 | −34.2 | 61.0 | 1603 |
| 46 | −34.2 | 61.0 | 662 |
| 48 | −34.2 | 61.0 | 9735 |
| 49 | −108.3 | 60.0 | 662 |
| 52 | −110.8 | 18.2 | 662 |
| 54 | −84.0 | 18.2 | 9735 |
| 60 | −35.0 | 36.0 | 1603 |
| 62 | −35.0 | 36.0 | 495 |
| 64 | −35.0 | 36.0 | 1108 |
| 68 | −44.2 | 18.2 | 1108 |
| 72 | −108.9 | 18.2 | 495 |
| 82 | 15.9 | 18.2 | 2052 |
| 84 | −110.3 | 18.0 | 14597 |
| 86 | 25.1 | 17.0 | 14597 |
| 88 | 40.0 | 25.1 | 14597 |
| 90 | 40.0 | 63.1 | 14597 |
| 92 | 40.0 | 63.1 | 1649 |
| 96 | −112.8 | 18.2 | 1649 |
| 115 | 30 | 62.0 | 12000 |
| 116 | 30.0 | 62.0 | 3000 |
| 118 | −23.0 | 19.2 | 3000 |
| 154 | −23.0 | 19.2 | 109 |
| 156 | −23.0 | 19.2 | 2891 |
| 158 | −23.3 | 18.2 | 109 |
| 160 | −104.5 | 18.2 | 2891 |
| 121C | 61.6 | 25.6 | 4577 |
| 121D | 61.6 | 25.6 | 10019 |

The reduction in the power consumed by the second compressor 36 in accordance with the flow introduced into the second dynamic pressure reduction turbine 112 is set out in Table 6 below.

TABLE 6

| Recovery of ethane mol% | Flow to turbine 112 kmol/h | Power of turbine 26 kW | Power of turbine 112 kW | Power of compressor 36 kW |
|---|---|---|---|---|
| 99.19 | 1000 | 3994 | 539 | 13772 |
| 99.18 | 1500 | 3851 | 809 | 13518 |
| 99.18 | 2000 | 3745 | 1078 | 13444 |
| 99.20 | 2500 | 3641 | 1348 | 13288 |
| 99.18 | 3000 | 3558 | 1617 | 13170 |
| 99.18 | 3500 | 3483 | 1887 | 13216 |

The fourth method according to the invention advantageously allows processing of charges comprising compounds which become solidified at very low temperature, whilst maintaining an excellent efficiency level of extraction and consumption of energy which is very low.

Figure 5:
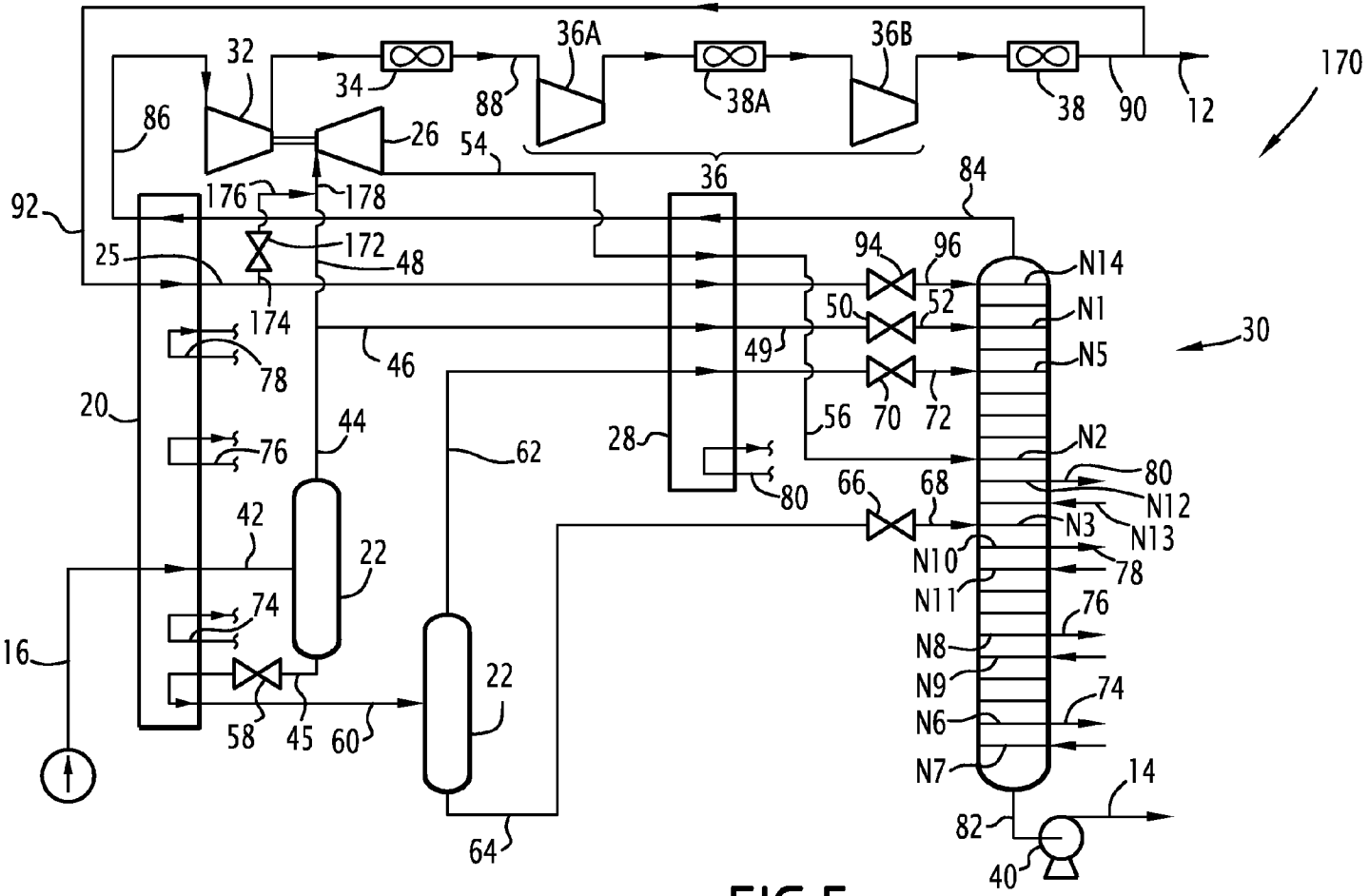
FIG. 5 is a functional schematic illustration of a fifth production installation intended for carrying out a fifth method according to the invention.

A fifth installation according to the invention 170 is illustrated in FIG. 5. That fifth installation 170 is intended to carry out a fifth method according to the invention.

The fifth installation 170 differs from the first installation 10 in that it comprises a valve 172 for branching off a portion of the extraction flow 92 in order to branch off that portion upstream of the first dynamic pressure reduction turbine 26.

In the example illustrated in FIG. 5, the second compressor 36 further comprises two compression stages 36A, 36B which are separated by an air cooler 38A.

The implementation of the fifth method according to the invention differs from the implementation of the first method in that a make-up cooling flow 174 is removed from the extraction flow 25 obtained after it has been passed into the first heat exchanger 20. The ratio of the molar flow rate of the flow 174 to the molar flow rate of the extraction flow 25 before removal is between 5 and 50%.

The fifth method has a supply flow 16 whose content of $C_2^+$ hydrocarbons is advantageously greater than 15%.

An example of a composition of the flow 16 for carrying out the fifth method according to the invention comprises, in moles, 0.35% of nitrogen, 80.03% of methane, 11.33% of ethane, 3.60% of propane, 1.64% of isobutane, 2.00% of n-butane, 0.24% of isopentane, 0.19% of n-pentane, 0.19% of n-hexane, 0.10% of n-heptane, 0.03% of n-octane and 0.30% of carbon dioxide.

Since the temperature of the $C_2^+$ cut at the bottom of the distillation column 30 is substantially of −0.5° C., it is advantageously reheated.

The make-up cooling flow 174 is removed downstream of the first exchanger 20 and upstream of the second exchanger 28. The flow 174 is introduced into the pressure reduction valve 172 in order to be subjected to pressure reduction therein as far as a pressure equivalent to that of the supply gas and to form a make-up cooling flow 176 subjected to pressure reduction. The flow 176 is reintroduced into the turbine supply fraction 48, upstream of the first dynamic pressure reduction turbine 26, and downstream of the separation location between the column supply fraction 46 and the turbine supply fraction 48.

The combination 178 of the flows 48 and 176 allows recovery of 5500 kW of energy in order to cool the effluent 54.

Furthermore, the partially compressed flow 88 is introduced into the first compression stage 36A in order to be compressed therein, then into the air cooler 38A, before being introduced into the second compression stage 36B. That allows a substantial improvement in terms of power consumed to be achieved.

Examples of temperature, pressure and molar flow rate of the different flows are set out in Table 7 below.

TABLE 7

| Flow | Temperature (° C.) | Pressure (bar) | Flow (kgmol/h) |
|---|---|---|---|
| 12 | 40.0 | 63.1 | 12078 |
| 14 | 1.0 | 31.9 | 2922 |
| 16 | 40.0 | 62.0 | 15000 |
| 42 | −24.0 | 61.0 | 15000 |
| 44 | −24.0 | 61.0 | 12635 |
| 45 | −24.0 | 61.0 | 2365 |
| 46 | −24.0 | 61.0 | 2100 |
| 48 | −24.0 | 61.0 | 10535 |
| 49 | −112.3 | 60.0 | 2100 |
| 52 | −112.0 | 15.0 | 2100 |
| 54 | −82.4 | 15.0 | 12535 |
| 56 | −93.3 | 15.0 | 12535 |
| 60 | −38.0 | 39.7 | 2365 |
| 62 | −38.0 | 39.7 | 423 |
| 64 | −38.0 | 39.7 | 1942 |
| 68 | −54.1 | 15.0 | 1942 |
| 72 | −112.4 | 15.0 | 423 |
| 82 | −0.5 | 15.0 | 2922 |
| 84 | −114.4 | 14.8 | 15648 |
| 86 | 37.3 | 13.8 | 15468 |
| 88 | 40.0 | 19.9 | 15468 |
| 90 | 40.0 | 63.1 | 15468 |
| 92 | 40.0 | 63.1 | 3390 |
| 96 | −115.6 | 15.0 | 1390 |
| 174 | −45.0 | 62.6 | 2000 |
| 176 | −46.1 | 61.0 | 2000 |
| 178 | −27.4 | 61.0 | 12535 |

The reduction of the power of the second compressor 36 in accordance with the flow recycled to the first dynamic pressure reduction turbine 26 is illustrated by Table 8 below.

TABLE 8

| Recovery of ethane mol% | Flow to turbine 26 kmol/h | Power of turbine 26 kW | Temperature of flow 56 ° C. | Power of compressor 36 kW |
|---|---|---|---|---|
| 99.18 | 0 | 5383 | −85.7 | 17506 |
| 99.19 | 200 | 5419 | −85.7 | 17159 |
| 99.18 | 500 | 5444 | −86.7 | 16967 |
| 99.20 | 800 | 5459 | −88.2 | 16847 |
| 99.19 | 1100 | 5475 | −89.7 | 16758 |
| 99.18 | 1700 | 5493 | −92.1 | 16658 |
| 99.17 | 2000 | 5499 | −93.2 | 16650 |
| 99.19 | 2100 | 5498 | −93.6 | 16665 |

A reduction of 4.9% in the power of the second compressor 36 is observed in relation to the first method according to the invention, which itself represents an increase of 5.2% in relation to the prior art carried out on that heavy gas.

Figure 6:
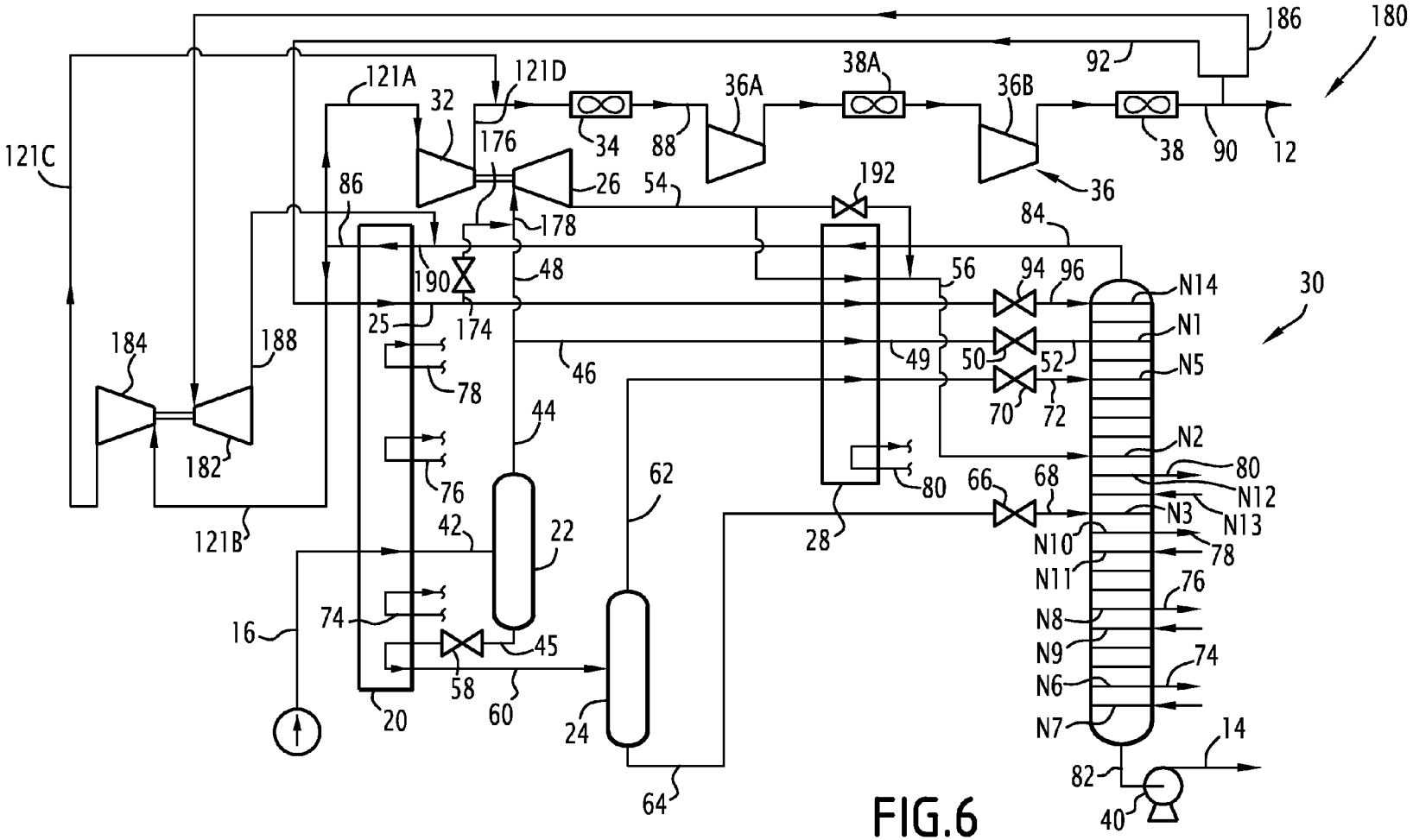
FIG. 6 is a functional schematic illustration of a sixth production installation intended for carrying out a sixth method according to the invention.

A sixth installation according to the invention is illustrated in FIG. 6. That sixth installation 180 differs from the fifth installation 150 owing to the presence of a downstream dynamic pressure reduction turbine 182 coupled to a downstream compressor 184.

Unlike the fifth method according to the invention, an auxiliary pressure reduction flow 186 is removed from the compressed upper flow 90 from the air cooler 38 parallel with the extraction flow 92.

The auxiliary pressure reduction flow 186 is conveyed to the downstream dynamic pressure reduction turbine 182 in order to be subjected to pressure reduction at that location to a pressure less than 40 bar and substantially of 15.3 bar. The auxiliary pressure reduction flow 188 subjected to pressure reduction from the turbine 182 is subsequently reintroduced into the upper flow 190, upstream of the first heat exchanger 20 and downstream of the second heat exchanger 28.

Furthermore, as in the fourth method according to the invention, the flow 86 from the first heat exchanger 20 is separated into a first recompression fraction 121A which is conveyed to the first compressor 32 and a second compression fraction 121B which is conveyed to the downstream compressor 184.

The ratio of the molar flow rate of the auxiliary pressure reduction flow 186 to the compressed upper flow 90 from the cooler 38 is less than 30% and is substantially between 10 and 30%.

Examples of temperature, pressure and molar flow rate of the different flows are set out in Table 9 below.

TABLE 9

| Flow | Temperature (° C.) | Pressure (bar) | Flow (kgmol/h) |
|---|---|---|---|
| 12 | 40.0 | 63.1 | 12076 |
| 14 | 3.8 | 31.9 | 2924 |
| 16 | 40.0 | 62.0 | 15000 |
| 42 | −31.0 | 61.0 | 15000 |
| 44 | −31.0 | 61.0 | 11946 |
| 45 | −31.0 | 61.0 | 3054 |
| 46 | −31.0 | 61.0 | 1905 |
| 48 | −31.0 | 61.0 | 10041 |
| 49 | −110.9 | 60.0 | 1905 |
| 52 | −110.7 | 16.0 | 1905 |
| 54 | −82.4 | 16.0 | 10091 |
| 56 | −89.9 | 15.9 | 10091 |
| 60 | −38.0 | 39.7 | 3054 |
| 62 | −38.0 | 39.7 | 795 |
| 64 | −38.0 | 39.7 | 2259 |
| 68 | −53.7 | 16.0 | 2259 |
| 72 | −110.5 | 16.0 | 795 |
| 82 | 2.4 | 16.0 | 2924 |
| 84 | −112.9 | 15.8 | 13126 |
| 86 | 33.5 | 14.8 | 16126 |
| 88 | 40 | 22.1 | 16126 |
| 90 | 40.0 | 63.1 | 16126 |
| 92 | 40.0 | 63.1 | 1050 |
| 96 | −114.0 | 16.0 | 1000 |
| 174 | −45.0 | 62.6 | 50 |
| 176 | −46.1 | 61.0 | 50 |
| 178 | −31.1 | 61.0 | 10091 |
| 186 | 40.0 | 63.1 | 3000 |
| 188 | −43.4 | 15.3 | 3000 |
| 190 | −43.4 | 15.3 | 16126 |
| 121C | 71.5 | 22.6 | 5328 |
| 121D | 71.5 | 22.6 | 10798 |

The reduction in the power of the compressor 36 in accordance with the flow conveyed to the first turbine 32 and the flow conveyed to the downstream turbine 182 is described in Table 10 below.

The total consumption of the method is further reduced in relation to the fifth method according to the invention in order to be 15716 kW, whereas that consumption was 16650 kW for the fifth method according to the invention.

TABLE 10

| Flow recycled to turbine 26 kmol/h | Power of turbine 26 kW | Flow at auxiliary turbine 182 kmol/h | Power of turbine 182 kW | Pressure of column 30 bar | Power of compressor 36 kW |
|---|---|---|---|---|---|
| 2000 | 5499 | 0 | 0 | 15 | 16650 |
| 1200 | 4733 | 1500 | 1031 | 15.4 | 16221 |
| 50 | 4085 | 3000 | 2015 | 16 | 15716 |

The recovery of ethane is substantially equal to 99.18% in the three cases.

In a variant, the installation 180 comprises a second branching valve 192 which is capable of conveying a portion of the flux 54 to the column 30 without being cooled, particularly in the second heat exchanger 28.

A fraction of the flow 54 can therefore be removed and pass into the valve 192 before being reintroduced into the fraction 56.

Figure 7:
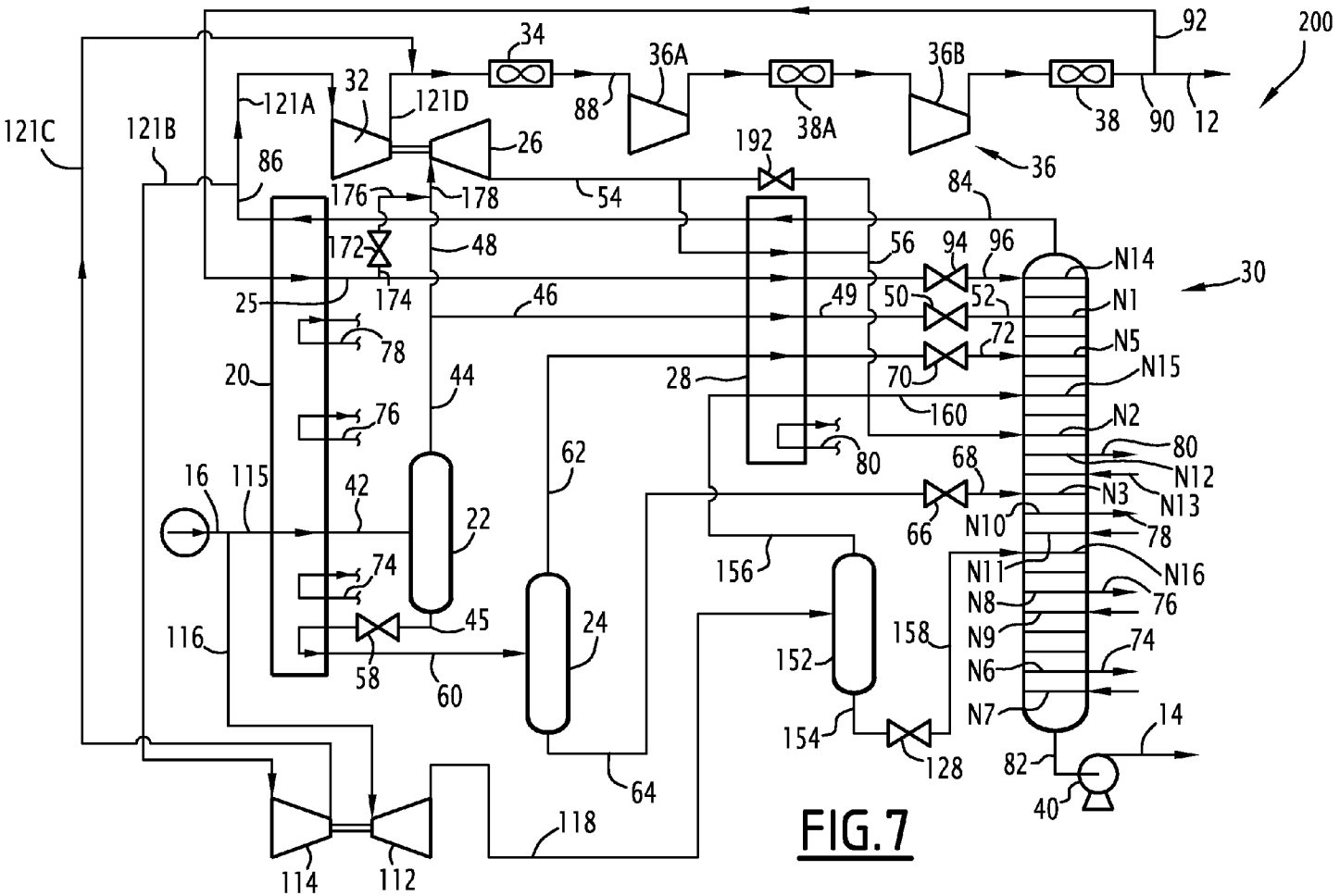
FIG. 7 is a functional schematic illustration of a seventh production installation intended for carrying out a seventh method according to the invention.

A seventh installation 200 according to the invention is illustrated in FIG. 7. Unlike the fifth installation 170 illustrated in FIG. 5, the seventh installation comprises, as in the fourth installation 150, a downstream separation flask 152 which receives the second supply fraction 118 subjected to pressure reduction after it has been passed into the second pressure reduction turbine 112.

As in the fourth installation 150, the third upper flow 156 passes into the second exchanger 28 in order to be cooled and partially liquefied therein and to form a cooled reflux flow 160.

The lower flow 154 from the downstream flask 152 is subjected to pressure reduction in the sixth static pressure reduction valve 128 in order to form a flow 158 which is subjected to pressure reduction and which is introduced into a lower portion of the column 30.

As in the sixth installation 180, the installation comprises a branch which is provided with a valve 192 which allows a portion of the effluent 54 from the first turbine 26 to be passed directly into the column 30 without passing via the second exchanger 28.

The seventh method is further carried out in a manner similar to that of the fifth method according to the invention. Examples of temperature, pressure and molar flow are set out in Table 11 below.

TABLE 11

| Flow b | Temperature (° C.) | Pressure (bar) | Flow (kgmol/h) |
|---|---|---|---|
| 12 | 40.0 | 63.1 | 12075 |
| 14 | −2.2 | 32.0 | 2925 |
| 16 | 40.0 | 62.0 | 15000 |
| 25 | −42.0 | 62.6 | 2710 |
| 42 | −31.7 | 61.0 | 12000 |
| 44 | −31.7 | 61.0 | 9498 |
| 45 | −31.7 | 61.0 | 2502 |
| 46 | −31.7 | 61.0 | 257 |
| 48 | −31.7 | 61.0 | 9241 |
| 49 | −114.0 | 60.0 | 257 |
| 52 | −114.2 | 14.0 | 257 |
| 54 | −89.4 | 14.0 | 10441 |
| 56 | −89.4 | 14.0 | 10441 |
| 60 | −36.0 | 36.0 | 2502 |
| 62 | −36.0 | 36.0 | 828 |
| 64 | −36.0 | 36.0 | 1674 |
| 68 | −50.9 | 14.0 | 1674 |
| 72 | −113.6 | 14.0 | 828 |
| 82 | −3.7 | 14.0 | 2925 |
| 84 | −116.0 | 13.8 | 14785 |
| 86 | 30.9 | 12.8 | 14785 |
| 88 | 40.0 | 20.5 | 14785 |
| 90 | 40.0 | 63.1 | 14785 |
| 92 | 40.0 | 63.1 | 2710 |
| 96 | −117.3 | 14.0 | 1510 |
| 115 | 40.0 | 62.0 | 12000 |
| 116 | 40.0 | 62.0 | 3000 |
| 118 | −25.3 | 14.5 | 3000 |
| 154 | −25.3 | 14.5 | 118 |
| 156 | −25.3 | 14.5 | 2882 |
| 158 | −25.5 | 14.0 | 118 |
| 160 | −108.8 | 14.0 | 2882 |
| 174 | −42.0 | 62.6 | 1200 |
| 176 | −43.0 | 61.0 | 1200 |

TABLE 11-continued

| Flow b | Temperature (° C.) | Pressure (bar) | Flow (kgmol/h) |
|---|---|---|---|
| 178 | −33.0 | 61.0 | 10441 |
| 121C | 75.3 | 21 | 4566 |
| 121D | 75.3 | 21 | 10220 |

The reduction in the power of the second compressor 36 in accordance with the increase in the flow recycled to the first pressure reduction turbine 26, fixing the flow recycled to the second pressure reduction turbine 112, is illustrated by Table 12 below.

TABLE 12

| Recovery of ethane mol% | Flow recycled to turbine 26 kmol/h | Power of turbine 26 kW | Power of compressor 36 kW | Flow at auxiliary turbine 112 kmol/h |
|---|---|---|---|---|
| 99.20 | 700 | 4491 | 15763 | 3000 |
| 99.19 | 1000 | 4531 | 15530 | 3000 |
| 99.20 | 1200 | 4543 | 15507 | 3000 |
| 99.19 | 1500 | 4578 | 15596 | 3000 |

It is possible to establish a reduction of 6.9% in the power supplied to the second compressor 36 relative to the installation illustrated in FIG. 5.

Figure 8:
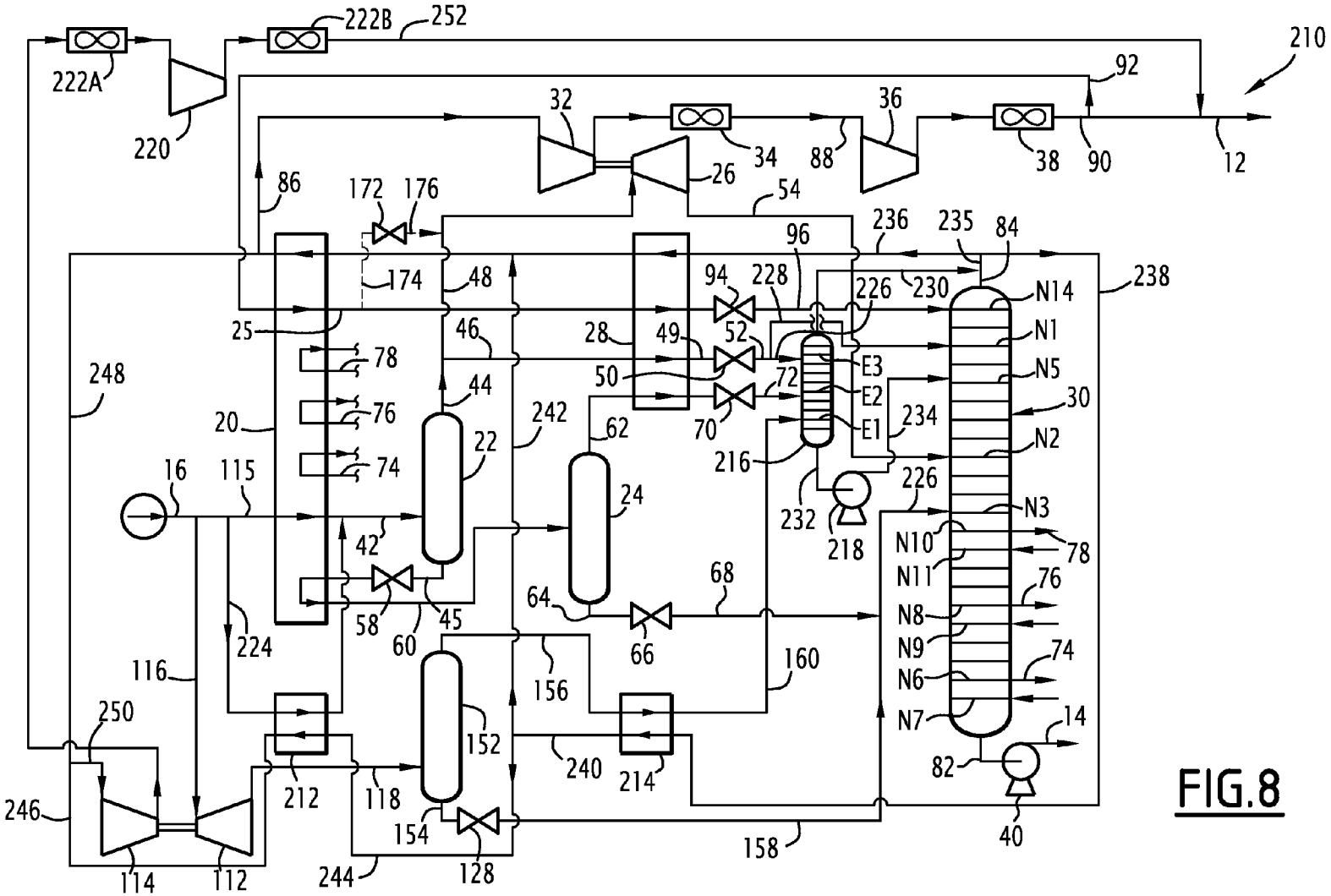
FIG. 8 is a functional schematic illustration of an eighth production installation intended for carrying out an eighth method according to the invention.

An eighth installation 210 according to the invention is illustrated in FIG. 8. That eighth installation 210 is intended to carry out an eighth method according to the invention.

The eighth installation 210 is advantageously intended to increase the capacity of an installation of the type which is described in the patent U.S. Pat. No. 6,578,379 and which comprises the first heat exchanger 20, the first separation flask 22, the second separation flask 24, the distillation column 30, the first compressor 32 coupled to the first pressure reduction turbine 26 and the second compressor 36.

As in the installation illustrated in FIG. 4, the eighth installation 210 further comprises a second dynamic pressure reduction turbine 112 and a third compressor 114, and a downstream flask 152 for receiving the effluent of the second dynamic pressure reduction turbine 112. The installation 210 further comprises an upstream heat exchanger 212, a downstream heat exchanger 214 and an auxiliary distillation column 216 provided with an auxiliary bottom pump 218.

The eighth installation 210 also comprises a fourth compressor 220 interposed between two air coolers 222A, 222B. The eighth method according to the invention differs from the fourth method according to the invention in that the supply flow 16 is further separated into a third supply flow fraction 224 which is introduced into the upstream heat exchanger 212, before forming, with the first fraction 115 from the exchanger 20, the first cooled fraction 42.

The ratio of the molar flow rate of the third fraction 224 to the molar flow rate of the supply flow 16 is greater than 5%. Unlike the fourth method, the third upper flow 156 from the downstream flask 152 is introduced into the downstream heat exchanger 214 in order to be cooled therein to a temperature less than −70° C. and to form the third cooled upper flow 160. The third cooled upper flow 160 is introduced into the auxiliary column 216 at a lower stage E1.

The column 216 has a number of theoretical stages less than the number of theoretical stages of the column 30. That number of stages is advantageously between 1 and 7. The auxiliary column 216 operates at a pressure which is substantially equal to that of the column 30.

The lower flow 158 subjected to pressure reduction and obtained after pressure reduction of the lower flow 154 in the valve 128 and the lower liquid fraction 68 obtained after pressure reduction of the lower fraction 64 in the valve 66 are mixed upstream of the column 30 in order to be introduced at the same location in the column 30. The two mixed flows 226 are introduced into the column 30 at a level N3 advantageously corresponding to the twelfth stage from the top of the column 30.

The upper vapour fraction 62 from the second separation flask 24 is introduced, after passage in the valve 70, at a middle stage E2 of the auxiliary column 216 located above the stage E1.

A first portion 226 of the fraction 52 subjected to pressure reduction in the valve 50 is introduced into the auxiliary column 216 at a stage E3 located above the level E2. A second portion 228 of the fraction 52 is introduced directly into the column 30 at the level N1.

The auxiliary column 216 produces an upper auxiliary flow 230 rich in methane and a lower auxiliary flow 232.

The upper auxiliary flow 230 is mixed with the upper flow 84 rich in methane produced by the distillation column 30.

The lower flow 232 is pumped by the auxiliary pump 218 in order to form a cooled reflux flow 234 which is introduced into the column 30 at the level N5.

Therefore, the flow 234 constitutes a cooled reflux flow which is obtained from a portion of an effluent 118 of a dynamic pressure reduction turbine 112, after separation of that effluent.

The mixture 235 of the upper flows 84 and 230 is separated into a first main upper flow fraction 236 and a second lesser upper flow fraction 238.

The ratio of the molar flow rate of the main fraction 236 to the lesser fraction 238 is greater than 1.5.

The main fraction 236 is introduced successively into the second heat exchanger 28, then into the first heat exchanger 20, in order to form the upper reheated flow 86 introduced into the first compressor 32.

The second upper flow fraction 238 is passed into the downstream heat exchanger 214 with counterflow of the third upper flow 156 in order to become reheated therein up to a temperature greater than −50° C. and to form a second reheated fraction 240.

The second reheated fraction 240 is subsequently separated into a return flow 242 and a compression flow 244.

The return flow 242 is reintroduced into the first upper flow fraction 236, downstream of the second exchanger 28 and upstream of the first exchanger 20 in order to partially form the reheated upper flow 86.

The recompression flow 244 is subsequently introduced into the upstream exchanger 212 in order to cool the third fraction of the supply flow 224. The flow 244 becomes heated up to a temperature greater than −10° C. in order to form a reheated recompression flow 246.

A first portion 248 of the recompression flow 246 is mixed with the first fraction of the upper flow 236, downstream of the first heat exchanger 20 in order to form the reheated upper flow 86.

A second portion 250 of the recompression flow 246 is introduced into the third compressor 114, then into the air cooler 222A, before being recompressed in the fourth compressor 220 and being introduced into the air cooler 222B. The second compressed portion 252 from the air cooler 222B has a temperature of less than 60° C. and in particular substantially of 40° C. and a pressure of greater than 35 bar and in particular of 63.1 bar.

That first compressed portion 252 is mixed with the compressed upper flow 90 downstream of the tapping location of the extraction flow 92 in order to form the flow rich in methane 12.

Unlike the first method, the heat exchanger 20 does not receive any reboiling flow from the column 30.

In a variant illustrated partially with broken lines in FIG. 8, an auxiliary cooling flow 174 is removed from the extraction flow 92 upstream of the exchanger 28 as in the fifth method according to the invention.

Therefore, the eighth installation 210 and the eighth method according to the invention allow an increase in the capacity of an installation of the existing prior art in order to increase the flow rate of the supply flow 16, without having to modify the existing equipment of the installation, and particularly keeping the heat exchangers 20, 28, the column 30, the compressors 32, 36 and the turbine 26 identical and using the inlets already present in the column 30.

Examples of temperature, pressure and molar flow rate of the different flows are set out in Table 13 below, for a charge comprising, in moles, 2.06% of nitrogen, 83.97% of methane, 6.31% of ethane, 3.66% of propane, 0.71% of isobutane, 1.49% of n-butane, 0.44% of iso-pentane, 0.5% of n-pentane, 0.19% of n-hexane, 0.10% of n-heptane, 0.03% of n-octane and 0.5% of carbon dioxide.

TABLE 13

| Flow | Temperature (° C.) | Pressure (bar) | Flow (kgmol/h) |
|---|---|---|---|
| 12 | 40.0 | 63.1 | 14880 |
| 14 | 14.0 | 22.6 | 2367 |
| 16 | 30.0 | 62.0 | 17250 |
| 42 | −31.0 | 61.0 | 13950 |
| 44 | −31.0 | 61.0 | 12280 |
| 45 | −31.0 | 61.0 | 1671 |
| 46 | −31.0 | 61.0 | 1689 |
| 48 | −31.0 | 61.0 | 10590 |
| 49 | −109.8 | 60.0 | 1689 |
| 54 | −82.0 | 17.6 | 10590 |
| 60 | −36.0 | 44.0 | 1671 |
| 62 | −36.0 | 44.0 | 299 |
| 64 | −36.0 | 44.6 | 1372 |
| 68 | −47.8 | 17.6 | 1372 |
| 72 | −110.8 | 17.6 | 299 |
| 82 | 13.6 | 17.6 | 2367 |
| 84 | −111.3 | 17.4 | 14498 |
| 86 | 27.6 | 16.4 | 14350 |
| 88 | 40.0 | 22.3 | 14350 |
| 90 | 40.0 | 63.1 | 14350 |
| 92 | 40.0 | 63.1 | 2100 |
| 96 | −113.7 | 17.6 | 2100 |
| 115 | 30.0 | 62.0 | 12450 |
| 116 | 30.0 | 62.0 | 3300 |
| 118 | −24.2 | 18.6 | 3300 |
| 154 | −24.2 | 18.6 | 122 |
| 156 | −24.2 | 18.6 | 3178 |
| 158 | −24.5 | 17.6 | 122 |
| 160 | −100.7 | 17.6 | 3178 |
| 224 | 30.0 | 62.0 | 1500 |
| 226 | −111.6 | 17.6 | 1679 |
| 228 | −111.6 | 17.6 | 10 |
| 230 | −109.6 | 17.6 | 2485 |
| 232 | −106.0 | 17.7 | 2672 |
| 235 | −111.1 | 17.4 | 16983 |
| 236 | −111.1 | 17.4 | 11306 |
| 238 | −111.1 | 17.4 | 5677 |
| 240 | −30.7 | 16.9 | 5677 |
| 242 | −30.7 | 16.9 | 2302 |
| 244 | −30.7 | 16.9 | 3375 |
| 246 | 18.7 | 16.4 | 3375 |

TABLE 13-continued

| Flow | Temperature (° C.) | Pressure (bar) | Flow (kgmol/h) |
|---|---|---|---|
| 248 | 18.7 | 16.4 | 745 |
| 250 | 18.7 | 16.4 | 2630 |
| 252 | 40.0 | 63.1 | 2630 |

Table 14 below illustrates the progressive increase in the flow rate of the supply flow 16. The recovery of $C_2^+$ in the flow 14 is greater than 99% and substantially of 99.1%. The power of the compressor 36 is kept constant at 14896 kW.

TABLE 14

| Supply flow % | Power of turbine 26 kW | Flow to turbine 112 kgmol/h | Power of turbine 112 kW | Power of compressor 220 kW | Pressure of column 30 Bar a |
|---|---|---|---|---|---|
| 100 | 4382 | 0 | 0 | 0 | 18.0 |
| 109 | 4160 | 2000 | 1086 | 529 | 18.0 |
| 115 | 4095 | 3300 | 1832 | 1415 | 17.4 |
| 120 | 4131 | 3950 | 2256 | 2588 | 16.7 |

In order to conserve the same recovery of $C_2^+$ as the existing unit, the pressure of the column 30 is slightly reduced. The presence of the new compressor 220 allows the power of the second compressor 36 to be kept the same, in spite of the flow increase.

Furthermore, the capacity of the first pressure reduction turbine 26 has been kept constant. The turbine 112 is used to process the addition of capacity.

The presence of an auxiliary column 216 also allows prevention of blockage of the column 30 during the increase of flow. The presence of the auxiliary flask 152 further prevents the problem of coagulation of the heavy elements contained in the supply flow.

In a variant, the eighth installation 210 according to the invention allows processing of a supply flow 16 containing more $C_2^+$ hydrocarbons.

Such a flow has, for example, a composition comprising, in moles, 1% of nitrogen, 86.25% of methane, 5.78% of ethane, 2.99% of propane, 0.71% of isobutane, 1.49% of n-butane, 1.28% of $C_5^+$ hydrocarbons and 0.5% of carbon dioxide, which constitutes the initial charge which will subsequently be supplemented with $C_2^+$, in accordance with Table 15 below. More generally, the enriched composition has more than 1 mol % of $C_5^+$ hydrocarbons.

The eighth installation according to the invention allows retention of recovery of ethane that is greater than 99%, in particular of 99.2%, and a temperature and a pressure of the supply flow 16 that are substantially the same. Similarly, the associated pressure drops in the equipment, the efficiency of the plates in the column 30 and the position of the extractions, the maximum specification of methane of the lower flow 82 of the column 30, the efficiency levels of the turbines and compressors, the power of the second compressor 36 and the existing turbine 26 and the heat exchange coefficients of the existing exchangers 20 and 28 are kept the same.

As illustrated in Table 15 below, it is possible to maintain a recovery of $C_2^+$ that is substantially identical to that of the prior art in spite of the increase in the content of $C_2^+$ hydrocarbons.

The recovery of $C_2^+$ from the flow 12 is greater than 99 mol %, advantageously of 99.2 mol %. The power of the compressor 36 is kept constant at 13790 kW. The pressure of the column 30 slightly decreases with the increase in the content of $C_2^+$, from 19.0 bar to 18.6 bar then to 17.8 bar.

TABLE 15

| Flow of cut 14 rich in $C_2^+$ kgmol/h | Power of turbine 26 kW | Flow to turbine 112 kgmol/h | Power of turbine 112 kW | Power of compressor 220 kW |
|---|---|---|---|---|
| 1872 | 4111 | 0 | 0 | 0 |
| 1970 | 4024 | 950 | 502 | 0 |
| 2051 | 3829 | 1840 | 1005 | 383 |

In this manner, the new compressor 220 allows a processed gas 12 that is rich in methane to be obtained under the same conditions as in the prior art.

In a variation of FIGS. 5 and 6, the installation comprises a second dynamic pressure reduction turbine 112, as shown in FIGS. 2, 3, 4, 7 or 8.

The supply flow 116 is then separated into a first fraction 115 of the supply flow and a second fraction 116 of the supply flow, which follows the path disclosed above in reference to any of FIGS. 2, 3, 4, 7 or 8.

What is claimed is:

1. A method of producing a flow rich in methane and a flow rich in C2+ hydrocarbons from a supply flow containing hydrocarbons, the method comprising:

separating the supply flow into a first fraction of the supply flow and at least a second fraction of the supply flow;

introducing the first fraction of the supply flow into a first heat exchanger;

cooling the first fraction of the supply flow in the first heat exchanger;

introducing the cooled first fraction of the supply flow into a first separation flask in order to produce a light upper flow and a heavy lower flow;

dividing the light upper flow into a turbine supply fraction and a column supply fraction;

pressure reducing the turbine supply fraction in a first dynamic pressure reduction turbine and introducing at least a portion of the turbine supply fraction subjected to pressure reduction into the first turbine in a middle portion of a first distillation column;

cooling and at least partially condensing the column supply fraction and pressure reducing and introducing at least a portion of the cooled column supply fraction into an upper portion of the first distillation column;

introducing the heavy lower flow into a second separation flask in order to produce an upper gas fraction and a lower liquid fraction;

pressure reducing the lower liquid fraction and introducing the lower liquid fraction in the middle portion of the first distillation column;

cooling and at least partially condensing the upper gas fraction;

recovering a lower column flow at the bottom of the first distillation column, the flow rich in $C_2^+$ hydrocarbons being formed from the lower column flow;

recovering and reheating of an upper column flow rich in methane;

compressing at least a fraction of the upper column flow in at least a first compressor coupled to the first dynamic pressure reduction turbine and in at least a second compressor;

forming the flow rich in methane from the reheated and compressed upper column flow;

removing an extraction flow from the upper column flow;

cooling the extraction flow in a second heat exchanger and introducing the cooled extraction flow into the upper portion of the first distillation column;

introducing at least a portion of the second fraction of the supply flow into a second dynamic pressure reduction turbine, separate from the first dynamic pressure reduction turbine;

forming an effluent from the second dynamic pressure reduction turbine;

cooling and at least partly liquefying at least a portion of the effluent from the second dynamic pressure reduction turbine in a downstream heat exchanger in heat exchange relationship with at least a fraction of the upper column flow, the downstream heat exchanger being separate from the second heat exchanger;

forming a cooled reflux flow from the portion of the effluent cooled in the downstream heat exchanger; and introducing the cooled reflux flow from the downstream heat exchanger into the first distillation column.

2. The method according to claim 1, wherein an upper gas flow obtained from the portion of the effluent cooled in the downstream heat exchanger is introduced into an auxiliary distillation column, the cooled reflux flow being formed from a lower flow of the auxiliary distillation column.

3. The method according to claim 2, further comprising:

introducing the effluent from the second dynamic pressure reduction turbine into a downstream separation flask in order to form at the top of the downstream separation flask the upper gas flow and at the bottom of the downstream separation flask a third lower liquid flow; and cooling the upper gas flow in the downstream heat exchanger and introducing the cooled upper gas flow in the auxiliary column.

4. The method according to claim 2, comprising producing an upper auxiliary flow from the auxiliary distillation column and mixing the upper auxiliary flow with the upper column flow rich in methane produced by the first distillation column.

5. The method according to claim 2, wherein at least a portion of the cooled and at least partially condensed upper gas fraction is introduced in the auxiliary distillation column.

6. The method according to claim 2, wherein a first portion of the cooled column supply fraction is introduced in the auxiliary distillation column, a second portion of the cooled column supply fraction being introduced directly into the first distillation column.

7. The method according to claim 1, wherein the portion of the second fraction of the supply flow introduced into the second dynamic pressure reduction turbine is conveyed from a separation point of the supply flow to the second dynamic pressure reduction turbine without passing through any heat exchanger.

8. The method according to claim 7, wherein an entirety of the second fraction of the supply flow is introduced into the second dynamic pressure reduction turbine without cooling between the step of separating the supply flow and the step of introducing the second fraction of the supply flow into the second dynamic pressure reduction turbine.

9. The method according to claim 1, comprising:

removing a secondary compression fraction from the upper column flow rich in methane, before the upper column flow rich in methane is passed into the first compressor;

passing the secondary compression fraction into a third compressor coupled to the second dynamic pressure reduction turbine; and introducing the compressed secondary compression fraction from the third compressor into the compressed upper column flow, downstream of the first compressor.

10. The method according to claim 1, comprising:

removing a make-up cooling flow from the upper column flow rich in methane or from a flow formed from the upper column flow rich in methane; and pressure reducing and introducing the make-up cooling flow subjected to pressure reduction into a flow flowing upstream of the first pressure reduction turbine.

11. The method according to claim 1, wherein the second compressor comprises a first compression stage, at least a second compression stage, and a cooler interposed between the first compression stage and the second compression stage, the method comprising:

passing the compressed upper column flow from the first compressor successively into the first compression stage, into the cooler, and then into the second compression stage.

12. The method according to claim 1, comprising pressure reducing and partially vaporizing the heavy lower flow in the first heat exchanger.

13. The method according to claim 1, comprising:

separating a third supply flow fraction from the supply flow, introducing the third supply flow fraction in an upstream heat exchanger, and cooling the third supply flow with flow issuing from the downstream heat exchanger.

14. An installation for producing a flow rich in methane and a flow rich in $C_2^+$ hydrocarbons from a supply flow containing hydrocarbons, the installation comprising:

a supply flow separator configured to separate the supply flow into a first fraction of the supply flow and at least a second fraction of the supply flow;

a first heat exchanger configured to cool the first fraction of the supply flow;

a first heat exchange introducer configured to introduce the first fraction of the supply flow into the first heat exchanger;

a first separation flask and a first separation flask introducer configured to introduce the cooled first fraction of the supply flow into the first separation flask in order to produce a light upper flow and a heavy lower flow;

a light upper flow divider configured to divide the light upper flow into a turbine supply fraction and a column supply fraction;

a first distillation column;

a turbine supply fraction pressure reducer configured to reduce a pressure of the turbine supply fraction comprising a first dynamic pressure reduction turbine and a first turbine introducer configured to introduce at least a portion of the fraction subjected to pressure reduction into the first turbine in a middle portion of the first distillation column;

a column supply fraction processor configured to cool and at least partially to condense the column supply fraction comprising a second heat exchanger and a cooled column supply fraction pressure reducer configured to reduce pressure of the cooled column supply fraction and to introduce at least a portion of the cooled column supply fraction into an upper portion of the first distillation column;

a second separation flask and a second separation flask introducer configured to introduce the heavy lower flow into the second separation flask in order to produce an upper gas fraction and a lower liquid fraction;

a pressure reducer configured to reduce the lower liquid fraction and a first distillation column introducer configured to introduce into the middle portion of the first distillation column;

an upper gas fraction cooler and condenser unit configured to cool and at least partially to condense the upper gas fraction a lower column flow recovery unit configured to recover a lower column flow at the bottom of the first distillation column, and a former configured to form the flow rich in $C_2^+$ hydrocarbons from the lower column flow;

an upper column flow recovery and reheating unit configured to recover and to reheat an upper column flow rich in methane, at the top of the first distillation column;

a compressor unit configured to compress at least a fraction of the upper column flow comprising at least a first compressor coupled to the first dynamic pressure reduction turbine and at least a second compressor;

a former configured to form the flow rich in methane from the reheated and compressed upper column flow;

a removal unit configured to remove from the upper column flow an extraction flow, an introducer configured to introduce the extraction flow in a second heat exchanger and the cooled extraction flow into an upper portion of the first distillation column;

a second dynamic pressure reduction turbine separate from the first dynamic pressure reduction turbine;

a second turbine introducer configured to introduce at least a portion of the second fraction of the supply flow into the second dynamic pressure reduction turbine;

an effluent former configured to form an effluent from the second dynamic pressure reduction turbine;

a downstream heat exchanger separate from the second heat exchanger, the downstream heat exchanger being configured to cool and at least partly liquefy at least a portion of the effluent from the dynamic pressure reduction turbine by heat exchange with at least a fraction of a upper column flow;

a cooled reflux flow former configured to form a cooled reflux flow from the portion of the effluent cooled in the downstream heat exchanger;

a reflux introducer configured to introduce the cooled reflux flow from the downstream heat exchanger into the first distillation column.

15. The installation according to claim 14, comprising:

an auxiliary distillation column, an upper gas flow introducer configured to introduce in the auxiliary distillation column an upper gas flow obtained from the portion of the effluent cooled in the downstream heat exchanger, and a cooled reflux flow former configured to form the cooled reflux flow from a lower flow of the auxiliary distillation column.

* * * * *